US012043977B2

(12) United States Patent
D'Amours et al.

(10) Patent No.: US 12,043,977 B2
(45) Date of Patent: Jul. 23, 2024

(54) BRACKET FOR REVERSIBLY MOUNTING AN EXCAVATOR BUCKET ON AN ARTICULATED ARM

(71) Applicant: GROUPE R.Y. BEAUDOIN INC., Victoriaville (CA)

(72) Inventors: Luc D'Amours, Victoriaville (CA); Alain Rivard, Victoriaville (CA); Rémi Beaudoin, Victoriaville (CA)

(73) Assignee: GROUP R.Y. BEAUDOIN INC., Victoriaville (CA)

( * ) Notice: Subject to any disclaimer, the term of this patent is extended or adjusted under 35 U.S.C. 154(b) by 534 days.

(21) Appl. No.: 17/230,710

(22) Filed: Apr. 14, 2021

(65) Prior Publication Data

US 2021/0270007 A1 Sep. 2, 2021

Related U.S. Application Data

(63) Continuation-in-part of application No. 16/153,006, filed on Oct. 5, 2018, now Pat. No. 11,466,424.

(60) Provisional application No. 62/568,868, filed on Oct. 6, 2017.

(51) Int. Cl.
*E02F 3/36* (2006.01)
*E02F 3/40* (2006.01)

(52) U.S. Cl.
CPC ..... *E02F 3/3618* (2013.01); *E02F 3/3631* (2013.01); *E02F 3/40* (2013.01); *E02F 3/3622* (2013.01); *E02F 3/364* (2013.01); *E02F 3/3686* (2013.01)

(58) Field of Classification Search
CPC ..... E02F 3/3631; E02F 3/40; E02F 3/3618; E02F 3/364; E02F 3/3622; E02F 3/3686
USPC ..... 414/723
See application file for complete search history.

(56) References Cited

U.S. PATENT DOCUMENTS

| | | | | |
|---|---|---|---|---|
| 3,130,843 A | | 4/1964 | Kelly | |
| 4,854,813 A | * | 8/1989 | Degeeter et al. | E02F 3/3622 172/753 |
| 4,948,328 A | | 8/1990 | Busch | |
| 5,024,010 A | * | 6/1991 | Hulden | E02F 3/3622 37/417 |
| 5,431,528 A | | 7/1995 | Jenkins et al. | |
| 5,611,158 A | | 3/1997 | Pratt et al. | |

(Continued)

FOREIGN PATENT DOCUMENTS

| | | | | |
|---|---|---|---|---|
| CA | 2731443 A1 | * | 8/2012 | E02F 3/3613 |
| CA | 2886709 A1 | * | 9/2016 | |

*Primary Examiner* — Thomas B Will
*Assistant Examiner* — Joel F. Mitchell
(74) *Attorney, Agent, or Firm* — Benoit & Cote Inc.; Ibrahim Tamer

(57) ABSTRACT

A bracket for mounting an excavation bucket on a coupler of an articulated arm. The bracket comprises a body extending in a plane and having a central portion. This bracket allows reversible mounting of the coupler of the excavation bucket by providing two pairs of adjacent concavities at a front and at a rear portion of the body which can alternately hold a corresponding pair of hinge shafts of a coupler in either orientation. Abutments at the front and at the rear are provided to further retain the coupler in the mounting bracket in either configuration. A bottom of the mounting bracket comprises notches that fit with corresponding portions of the bucket for improved securing of the bucket assembly on the mounting bracket.

11 Claims, 23 Drawing Sheets

(56) References Cited

U.S. PATENT DOCUMENTS

| | | | | |
|---|---|---|---|---|
| 7,014,385 | B2 | 3/2006 | Lim et al. | |
| 7,198,451 | B2 * | 4/2007 | Wimmer | E02F 3/364 37/468 |
| 7,267,521 | B1 | 9/2007 | Smith | |
| 10,794,036 | B2 | 10/2020 | Doyle | |
| 2006/0242865 | A1 * | 11/2006 | Herguido Fo | E02F 3/3613 37/468 |
| 2011/0262212 | A1 * | 10/2011 | Luyendijk et al. | E02F 3/3618 403/31 |
| 2018/0002888 | A1 | 1/2018 | Doyle | |

* cited by examiner

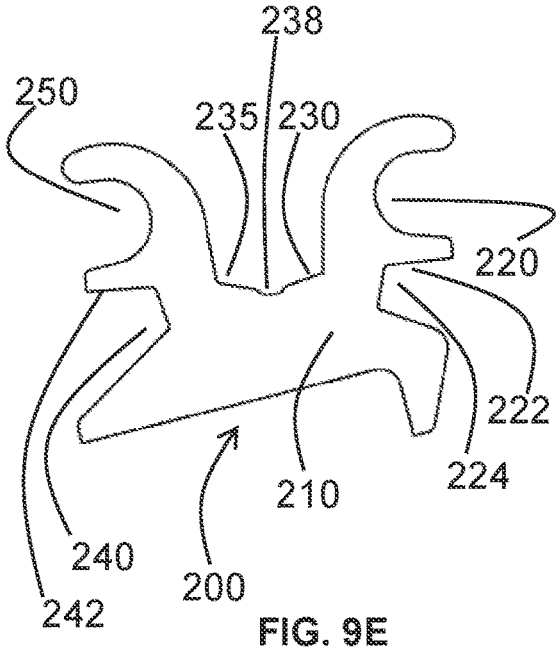
FIG. 9E
FIG. 9F
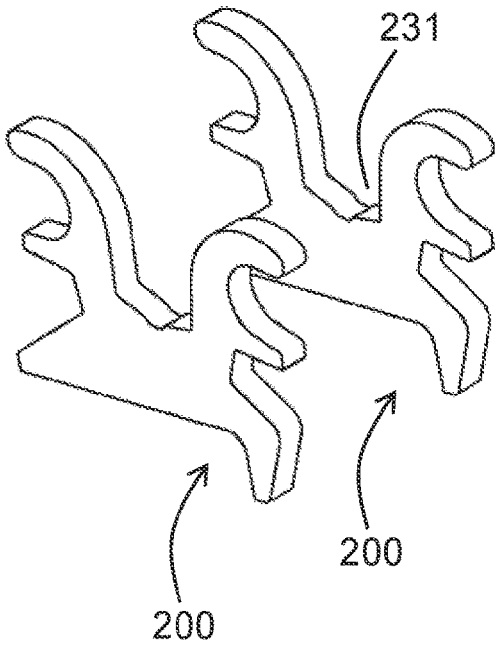

BRACKET FOR REVERSIBLY MOUNTING AN EXCAVATOR BUCKET ON AN ARTICULATED ARM

CROSS-REFERENCE TO RELATED APPLICATIONS

This application is a continuation-in-part of U.S. Ser. No. 16/153,006, filed Oct. 5, 2018, which claims benefit of U.S. patent application 62/568,868 filed Oct. 6, 2017, the specification of which is hereby incorporated herein by reference in its entirety.

BACKGROUND

(a) Field

The subject matter disclosed generally relates to construction vehicle equipment. More specifically, it relates to a bracket for an excavator bucket.

(b) Related Prior Art

Excavators are known for their articulated arm, extending from the vehicle, at the end of which a bucket is mounted. The bucket is normally mounted onto the articulated arm using a coupler to which a link of the articulated arm is attachable.

The bucket is oriented at the end of the articulated arm to perform various tasks, such as scraping material or transporting a load. The bracket and coupler mounted together are used in a given configuration which connects the bucket to the articulated arm in a single orientation.

BRIEF DESCRIPTION OF THE DRAWINGS

Further features and advantages of the present disclosure will become apparent from the following detailed description, taken in combination with the appended drawings, in which:

FIGS. 9E-9F are a perspective view and a side view of the mounting bracket of FIGS. 9A-9D;

It will be noted that throughout the appended drawings, like features are identified by like reference numerals.

SUMMARY

Figure 1B:
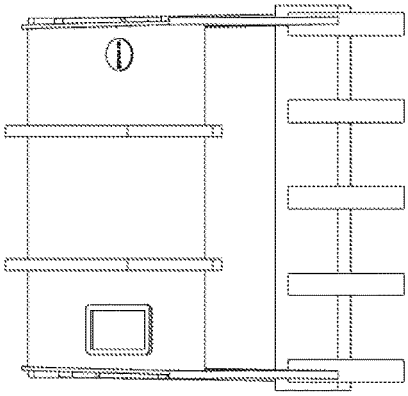
FIGS. 1A-1D are a perspective view, a top view, a front view and a side view, respectively, illustrating an excavator bucket including a mounting bracket, according to the prior art.
Figure 1A:
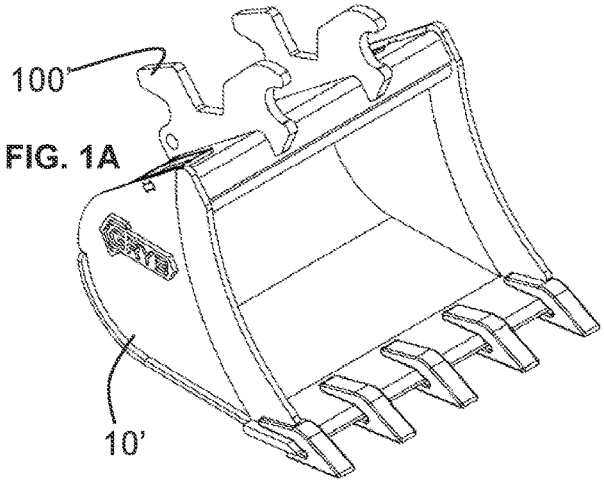
Figure 1D:
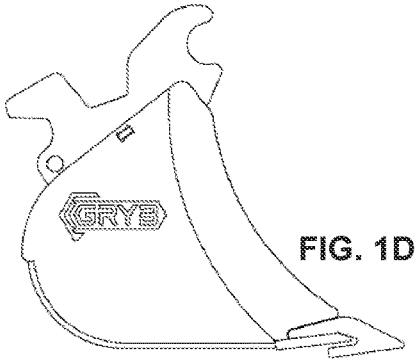
Figure 1C:
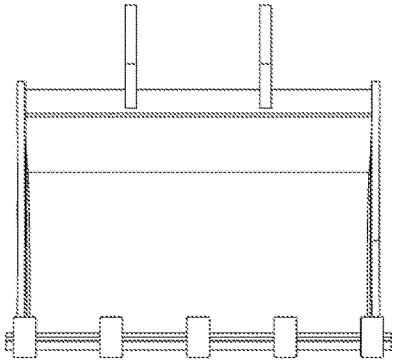
FIG. 1C PRIOR ART

According to an aspect of the invention, there is provided a bracket for reversibly mounting an excavation bucket on a coupler of an articulated arm, the bracket comprising:

a body extending in a plane and having a centroid;

a first rear concavity and a second rear concavity which are adjacent on the body by a rear portion thereof, the first rear concavity more rearwardly located and oriented frontwardly and the second rear concavity closer to the centroid of the body and oriented upwardly;

a first front concavity and a second front concavity which are adjacent on the body by a front portion thereof, the first rear concavity closer to the centroid of the body and oriented upwardly and the second rear concavity more frontwardly located and oriented reawardly;

wherein the first rear concavity and the second front concavity are for alternately receiving one of the hinge shaft or stopper thereof of the coupler;

wherein the second rear concavity and the first front concavity are for alternately receiving another one of the hinge shaft or stopper thereof of the coupler, thus allowing reversible mounting on the coupler.

According to an embodiment, there is further provided:

a first abutment formed at a rear portion of the body for receiving a blocking bar of the coupler in the first one of two reversible configurations; and a second abutment formed at a front portion of the body for receiving a blocking bar of the coupler in the second one of two reversible configurations.

According to an embodiment, there is further provided a notch at a bottom of the mounting bracket for conforming to a corresponding portion of a bucket assembled with the coupler.

According to an embodiment, the notch is formed at a bottom of a downward arm, a base thereof located by the second abutment formed at a front portion of the body.

According to an embodiment, the second front concavity is formed by a front arm extending upwardly at the front portion of the body, a base of said front arm comprising the second abutment.

According to an embodiment, the first abutment formed at the rear portion of the body notch is formed at an upper edge of a rear concavity, a bottom thereof forming a spur which is for conforming to a corresponding portion of a bucket assembled with the coupler.

According to an embodiment, the first rear concavity is formed by a rear arm extending upwardly at the rear portion of the body, a base of said rear arm comprising the first abutment.

According to an embodiment, the first rear concavity and the second rear concavity have a same radius of curvature and respectively form an arc-of-circle, both being in contact and joined at a rear apex.

According to an embodiment, the first front concavity and the second front concavity have a same radius of curvature and respectively form an arc-of-circle, both being in contact and joined at a front apex.

According to an aspect of the invention, there is provided a method for reversibly mounting an excavation bucket on a coupler of an articulated arm, the method comprising:

providing a bracket comprising:

a body extending in a plane and having a centroid;

a first rear concavity and a second rear concavity which are adjacent on the body by a rear portion thereof, the first rear concavity more rearwardly located and oriented frontwardly and the second rear concavity closer to the centroid of the body and oriented upwardly;

a first front concavity and a second front concavity which are adjacent on the body by a front portion thereof, the first rear concavity closer to the centroid of the body and oriented upwardly and the second rear concavity more frontwardly located and oriented reawardly;

in a first standard configuration of the coupler:

inserting a rear hinge shaft of the coupler or a side stopper thereof in the second rear concavity;

inserting a front hinge shaft of the coupler or a side stopper thereof in the second front concavity;

reversibly mounting the bracket and the coupler into a second reversed configuration by:

removing the bracket from the coupler inserting a rear hinge shaft of the coupler or a side stopper thereof in the first front concavity; and inserting a front hinge shaft of the coupler or a side stopper thereof in the first rear concavity.

According to an embodiment, there are further provided the steps of:

in the first standard configuration of the coupler:

abutting a blocking bar of the coupler on a rear abutment at a rear portion of the bracket;

and in reversibly mounting the bracket and the coupler into the second reversed configuration:

abutting the blocking bar of the coupler on a front abutment at a rear portion of the bracket.

According to an aspect of the invention, there is provided a bracket for reversibly mounting an excavation bucket on a coupler of an articulated arm, the bracket comprising:

a body extending in a plane and having a central portion;

a first concavity located on a first side of the body with respect to the central portion, the first concavity substantially having an arc-of-circle shape to receive and conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape for receiving the hinge shaft of the coupler in a second one of the two reversible configurations thus allowing reversible mounting on the coupler;

a first abutment edge formed by the central portion of the body for receiving a stopper of the coupler in the first one of two reversible configurations; and a second abutment edge aside the first abutment edge and further from the central portion of the body compared to the first abutment edge, for receiving the stopper of the coupler in the second one of two reversible configurations.

According to an embodiment, the first concavity ends with a straight portion for receiving the blocking bar of the coupler in the second one of the two reversible configurations.

According to an embodiment, the third concavity is located above the second concavity on the second side of the body.

According to an embodiment, the first abutment edge and the second abutment edge formed by the central portion of the body are located between the first concavity and the third concavity.

According to an embodiment, the first abutment edge and the second abutment edge together form a two-stair shape on the body of the bracket to make the bracket adapted to receive the stopper of the coupler in any one of two reversible configurations.

According to an embodiment, the first concavity and the third concavity are each oriented to open outwardly from the central portion of the body.

According to an embodiment, the first concavity is oriented to open outwardly from the central portion of the body and the third concavity is oriented to open inwardly with respect to the central portion of the body.

According to another aspect of the invention, there is provided a bracket for mounting an excavation bucket on a coupler of an articulated arm, the bracket comprising:

a body extending in a plane and having a central portion;

a first concavity on a first side of the body with respect to the central portion, the first concavity substantially having an arc-of-circle shape to conform with a surface of a hinge shaft of the coupler in a first one of two reversible configurations and hinge therearound;

a second concavity on a second side of the body opposite the first side with respect to the central portion, for receiving a blocking bar of the coupler in the first one of two reversible configurations;

a third concavity on the second side of the body, the third concavity substantially having the arc-of-circle shape, for receiving the hinge shaft of the coupler in a second one of the two reversible configurations thus allowing reversible mounting on the coupler; and a fourth concavity on a first side of the body opposite the first side with respect to the central portion, for receiving a blocking bar of the coupler in the second one of two reversible configurations.

According to an embodiment, the body comprises a hollow central portion by the central portion of the body.

According to an embodiment, the fourth concavity is substantially the same shape as the second concavity, mirrored in the first side.

According to an embodiment, the second concavity is located above the third concavity.

According to an embodiment, the first concavity is located above the fourth concavity.

According to an embodiment, the hollow central portion is substantially symmetrical.

According to an embodiment, the hollow central portion comprises a recess and the recess is provided at a bottom thereof.

According to an embodiment, the hollow central portion comprises a first abutment edge and a second abutment edge on either sides of the recess provided at the bottom of the hollow central portion to make the bracket adapted to receive the a stopper coupler in any one of two reversible configurations and hold the stopper firmly by abutting on one of the first abutment edge and the second abutment edge and being confined at a corner of the stopper by the other one of the first abutment edge and the second abutment edge.

According to another aspect of the invention, there is provided a method for reversibly mounting an excavation bucket on a coupler of an articulated arm, the method comprising:

providing a bracket comprising a body extending in a plane and having a central portion;

in a first configuration of the coupler:

inserting a hinge shaft of the coupler in a first concavity on a first side of the body, the first concavity substantially having an arc-of-circle shape to conform with a surface of the hinge shaft and hinge therearound;

inserting a blocking bar of the coupler in a second concavity on a second side of the body opposite the first side with respect to the central portion;

abutting a stopper of the coupler by the central portion of the body of the bracket, and reversibly mounting the bracket and the coupler by:

removing the bracket from the coupler inserting the hinge shaft of the coupler in a third concavity on the second side of the body, the third concavity substantially having the arc-of-circle shape;

abutting the blocking bar of the coupler in a second concavity onto an edge of the first concavity;

reversibly abutting the stopper of the coupler by the central portion of the body of the bracket.

According to an embodiment, the first concavity and the third concavity are each oriented to open outwardly from the central portion of the body.

According to an embodiment, the first concavity is oriented to open outwardly from the central portion of the body and the third concavity is oriented

DETAILED DESCRIPTION

Figure 2B:
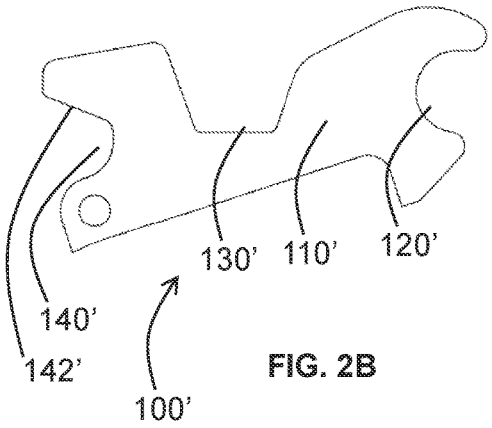
FIGS. 2A-2B are a perspective view and a side view, respectively, illustrating a bracket for mounting an excavator bucket on an articulated arm, according to the prior art.
Figure 2A:
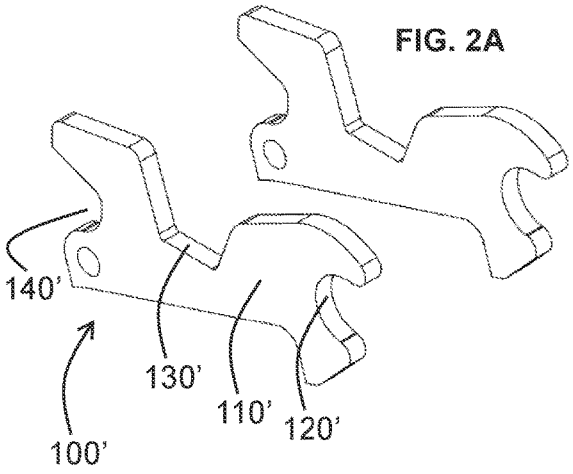
FIG. 2A PRIOR ART

FIGS. 1A-1D illustrate a bucket 10' including a mounting bracket 100', according to the prior art. A typical excavation bucket 10' is shown is these figures. The mounting bracket 100', shown in FIGS. 2A-2B, is secured on top of the bucket 10'. As shown in FIGS. 3A-3D, the mounting bracket 100' is for cooperation with a dedicated coupler 20 on an articulated arm, such as an articulated arm found on a construction vehicle.

Figure 4B:
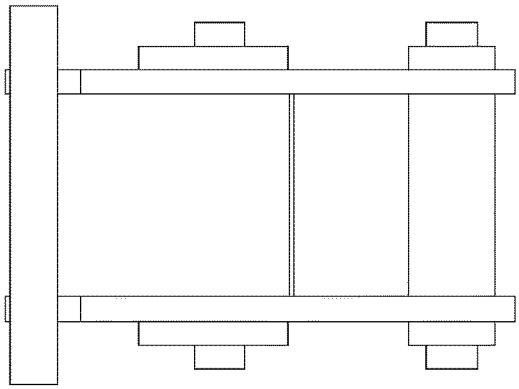
FIGS. 4A-4C are a perspective view, a top view and a side view, respectively, illustrating the coupler of the articulated arm.
Figure 4C:
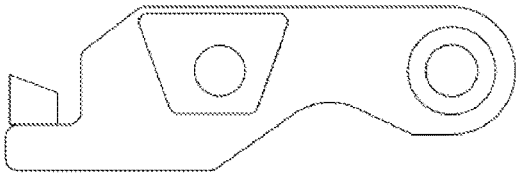
Figure 4A:
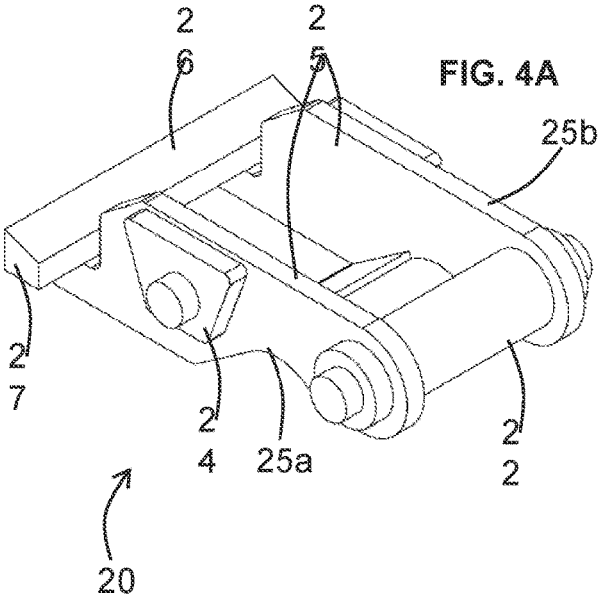
FIG. 4A PRIOR ART
Figure 5B:
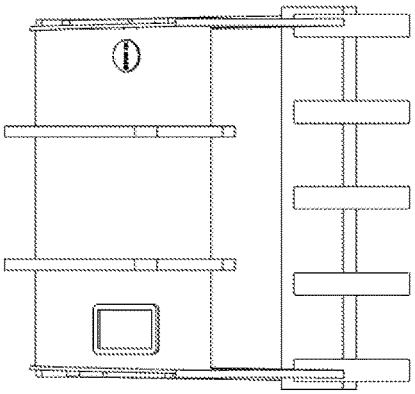
FIGS. 5A-5D are a perspective view, a top view, a front view and a side view, respectively, illustrating an excavator bucket including a mounting bracket, according to a first embodiment of the invention.
Figure 5A:
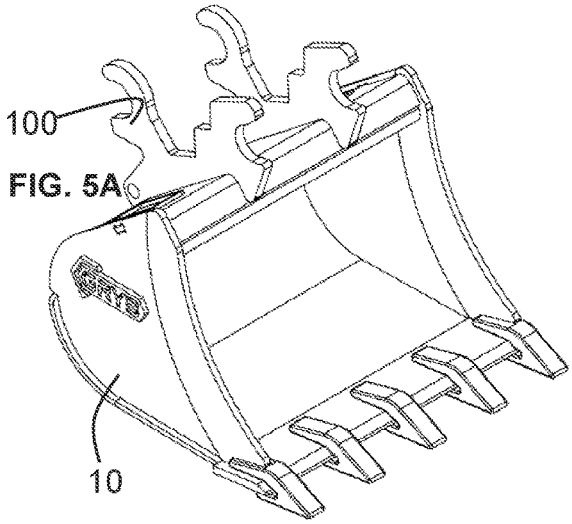
Figure 5D:
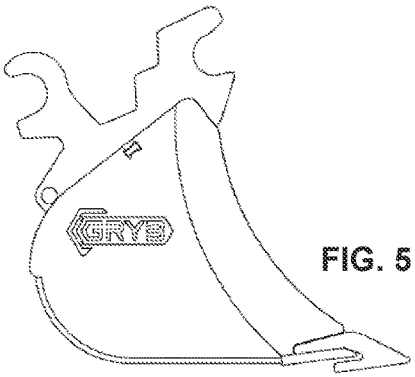
Figure 5C:
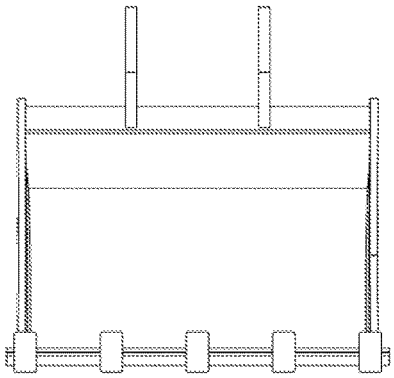

The coupler 20 is shown in FIGS. 4A-4C. The coupler 20 is standard and can be used with the bracket according to the prior art, or with the bucket according to the invention as described below. The coupler comprises a body 25 which may comprise a pair of parallel arms 25*a*, 25*b*, for example, as shown in FIG. 4A where the body is formed by two parallel elongated plates (i.e., arms 25*a*, 25*b*) forming each side of the body 25. Each of these side arms 25*a*, 25*b* comprises a stopper 24, each stopper 24 protruding outwardly on the sides of the coupler 20 (i.e., protruding toward the outside, from the side arms of the body 25) and providing a surface or edge for abutting onto a location on the bracket 100' and confine movement. The cross-section of the stopper 24 can have a rectangular or trapezoidal shape.

The body 25, with the pair of arms 25*a*, 25*b*, holds at one end of the arms a cylinder acting as a shaft, namely the hinge shaft 22, around which the bracket 100' can hinge. The hinge shaft 22 is cylindrical to provide rotatability around it. At a location opposite the hinge shaft 22 with respect to a central portion of the coupler 20 (i.e., at another end of the arms 25*a*, 25*b*), the coupler comprises a blocking bar 26 which extends parallel to the hinge shaft 22 and which contributes to securing the bracket to the coupler 20, along with the hinge shaft 22 and the stopper 24.

As shown in FIGS. 2A-2B, the prior art bracket 100', provided in pair, comprises a body 110' which extends in a plane and forms the solid base of one of the brackets 100' in the pair. The body 110' is shaped such as it comprises a first concavity 120' which is carved out from a side of the body in a concave fashion (i.e., toward a central portion of the body 110') and which an arc-of-circle shape conforms to a part of the cylindrical surface of the hinge shaft 22, which has a cylinder shape. This shape makes the first concavity 120' suitable to receive the hinge shaft 22 of the coupler 20 and thereby act as a hinge shaft receiver.

A second concavity 140' is carved out from the body 110' at a side thereof which is substantially opposite the first concavity 120' with respect to the central portion of the body 110'. The second concavity 140' is concave toward the central portion of the body 110'. It does not need to have an arc-of-circle or otherwise rounded shape. However, the second concavity 140' needs to conform with a portion of the surface of the blocking bar 26.

An abutment edge 130 is provided by the central portion, where the body narrows down and offers a substantially flat edge on which the stopper 24 of the coupler 20 can abut when the mounting bracket is mounted on the coupler 20.

The mounting bracket 100' is thus sandwiched between the hinge shaft 22, the blocking bar 26 and the stopper 24, and can securely hinge by the hinge shaft 22 to perform scraping, transportation and similar tasks. The bucket 10' of the prior art can be used to scrape material such as soil, sand, gravel, etc. However, the bucket 10' can only be installed on the articulated arm in a single orientation. This single standard orientation is provided by having the coupler 20 lock with the first concavity 120', the straight portion 142' of the second concavity 140', and the first abutment edge 130'.

The mounting bracket 100' according to the prior art and the coupler mounted together are used in a given configuration which connects the bucket to the articulated arm in a single orientation. There is now described below an embodiment which allows such a mounting to be reversible to allow two opposite configurations of the bucket on the articulated arm.

Now referring to FIGS. 5A-5D, there is shown a bucket 10 onto which there is secured a mounting bracket 100, according to an embodiment of the invention, which can be reversibly mounted on the coupler 20 to allow using the bucket 10 in two different orientations with respect to the articulated arm. This ensures that the bucket can be used in the most suitable orientation (e.g., upward or downward) for a given application. More particularly, as will be understood below, the mounting bracket can allow the bucket 10 to be mounted in a standard orientation, as discussion above in relation with the prior art, or in a reversed orientation. The first or standard orientation is provided by having the coupler 20 lock with the first concavity 120, the straight portion 142 of the second concavity 140, and the first abutment edge 130. The second or reversed orientation is provided by having the coupler 20 lock with the third concavity 150, the straight portion 122 of the first concavity 120, and the second abutment edge 135.

Figure 6B:
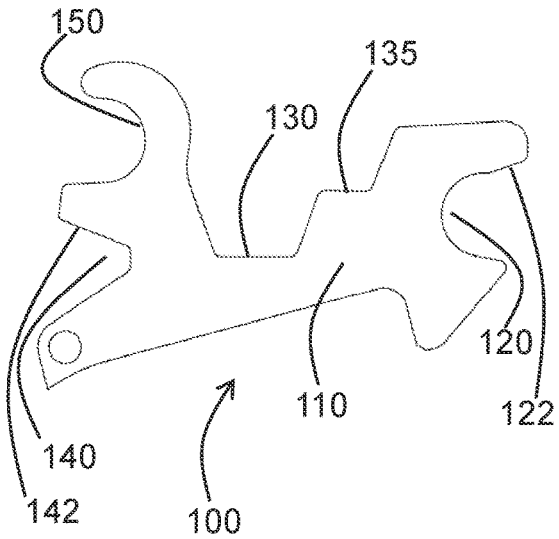
FIGS. 6A-6B are a perspective view and a side view, respectively, illustrating a bracket for mounting an excavator bucket on an articulated arm, according to the prior art.
Figure 6A:
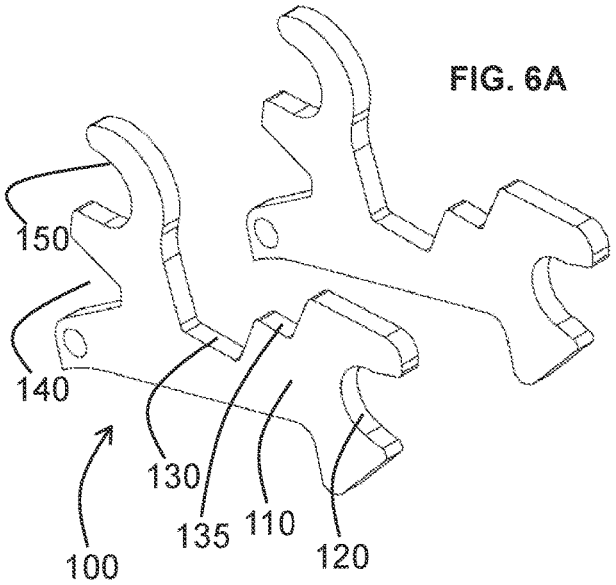

The mounting bracket 100 according to a first embodiment of the invention is shown in FIGS. 6A-6B. The mounting bracket 100 comprises all the features of the mounting bracket 100' of the prior art. Therefore, the bracket 100 comprises a body 110 which forms the solid base of the bracket 100. The body 110 is shaped such as it comprises a first concavity 120 which is carved out from a side of the body in a concave fashion (i.e., carved toward a central portion of the body 110 such that it forms an outward opening) and which has an arc-of-circle shape conforms to a part of the cylindrical surface of the hinge shaft 22, which has a cylinder shape. This shape makes the first concavity, having its opening directed outwardly, suitable to receive the hinge shaft 22 of the coupler 20 and thereby act as a hinge shaft receiver. Moreover, the first concavity 120 comprises a portion 122 that conforms with a portion of the surface of the blocking bar 26. According to an embodiment, the portion 122 that conforms with a portion of the surface of the blocking bar 26 is a straight portion within or at the edge of the portion otherwise shaped as an arc of circle. In the embodiment as shown in FIG. 6B, the arc-of-circle portion ends with the straight portion 122. This straight portion 122 can be at the upper edge of the portion shaped as an arc of circle, as shown in FIGS. 6A-6B where the arc of circle ends with, or is continued by, the straight portion. This straight portion has an angle that conforms with the surface of the blocking bar 26. Notably, it forms an angle that corresponds with an angle of the trapeze cross-section 27 of the blocking bar 26.

A second concavity 140 is carved out from the body 110 at a side thereof which is substantially opposite the first concavity 120 with respect to the central portion of the body 110. The second concavity 140 is concave toward the central portion of the body 110. It does not need to have an arc-of-circle or otherwise rounded shape. The second concavity 140 needs to grossly conform with a portion of the surface of the blocking bar 26. Moreover, the second concavity 140 comprises a portion 142 that conforms with a portion of the surface of the blocking bar 26. According to an embodiment, the portion 142 that conforms with a portion of the surface of the blocking bar 26 is a straight portion, similar to that of the first concavity 210, and as shown in FIGS. 6A-6B where the second concavity 140 comprises a straight portion 142. This straight portion has an angle that conforms with the surface of the blocking bar 26. Notably, it forms an angle that corresponds with an angle of the trapeze cross-section 27 of the blocking bar 26.

A first abutment edge 130 is provided by the central portion, where the body narrows down and offers a substantially flat edge on which the stopper 24 of the coupler 20 can abut when the mounting bracket is mounted on the coupler 20.

Moreover, and in addition to the prior art bracket 100', the bracket 100 comprises a second abutment edge 135. The second abutment edge 135 is shaped similarly as the first abutment edge 130 and is located at a position which is close to the first abutment edge 130. Both should be substantially parallel. The second abutment edge 135 is located at a different level compared to the first abutment edge 130, such as forming two steps. According to an embodiment, the second abutment edge 135 is located aside the first abutment edge 130 and further from the central portion of the body 110, thus forming the two-step stair. The second abutment edge 135 is suited to receive the stopper 24 of the coupler 20. More precisely, while the first abutment edge 130 is adapted to receive a first edge of the stopper 24, the second abutment edge 135 it adapted to receive a second edge of the stopper 24 which is located opposite the first edge of the stopper with respect to a central portion of the stopper 24. This two-stair shape on the body 110 of the bracket 100 makes the bracket 100 adapted to receive the coupler 20 in the standard orientation, as shown in FIGS. 3A and 7A, and further adapted to receive the coupler 20 in an orientation opposite the standard orientation, as shown in FIG. 8A.

Moreover, and in addition to the prior art bracket 100', the bracket 100 comprises a third concavity 150. The third concavity 150 should be of a shape substantially similar to the first concavity 120, or to the prior art first concavity 120' since the straight portion at an angle adapted for receiving the blocking bar 26 is not required for the third concavity 150. The third concavity 150 should be located approximately opposite the first concavity 120 with respect to the first concavity 120, and thus be located very close to the second concavity 140. According to an embodiment, the third concavity should be provided above the second concavity if the first abutment edge 130 and the second abutment edge 135 are also located above the central portion of the body 110, as shown in FIGS. 6A-6B.

By having a shape substantially similar to the first concavity 120, with an arc-of-circle shape conforms to a part of the cylindrical surface of the hinge shaft 22, the third concavity 150 can conform to a part of the cylindrical surface of the hinge shaft 22, which has a cylinder shape. This shape makes the third concavity suitable to receive the hinge shaft 22 of the coupler 20 and thereby act as a hinge shaft receiver, as for the first concavity 120.

Figure 3B:
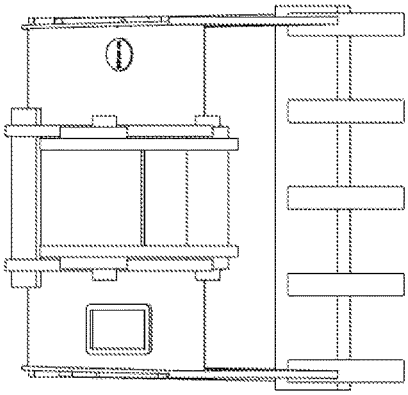
FIGS. 3A-3D are a perspective view, a top view, a front view and a side view, respectively, illustrating an excavator bucket including a bracket cooperatively mounted on the coupler of the articulated arm, according to the prior art.
Figure 3A:
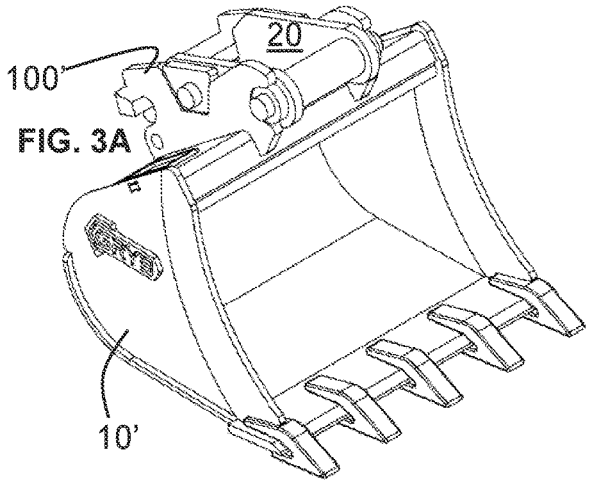
Figure 3D:
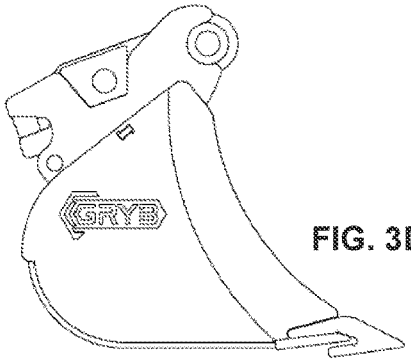
Figure 3C:
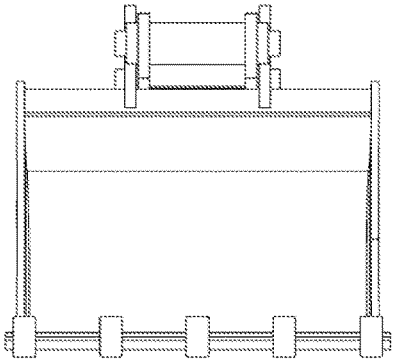
FIG. 3C PRIOR ART
Figure 7B:
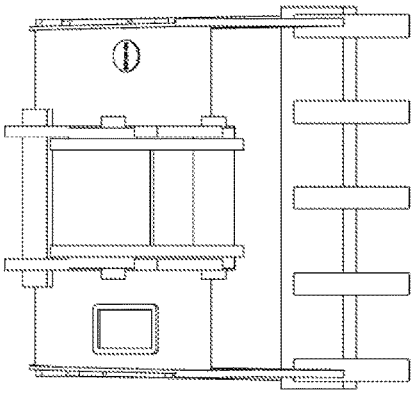
FIGS. 7A-7D are a perspective view, a top view, a front view and a side view, respectively, illustrating an excavator bucket including a mounting bracket cooperatively mounted on the coupler of the articulated arm, according to an embodiment, in the same orientation as in the prior art.
Figure 7A:
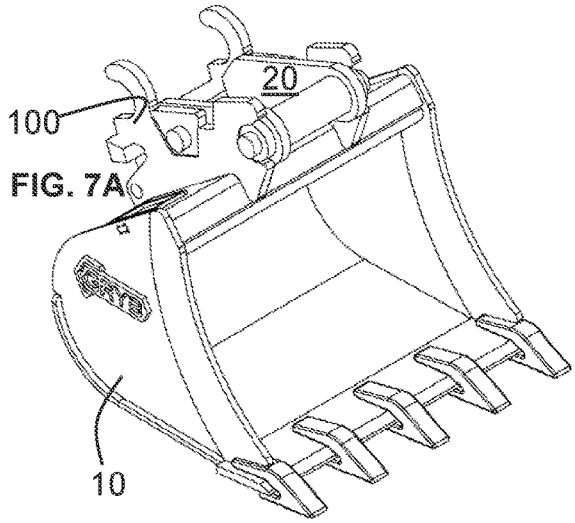
Figure 7D:
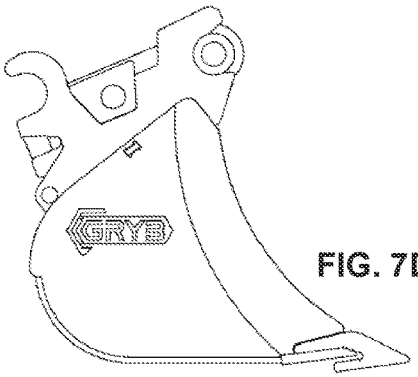
Figure 7C:
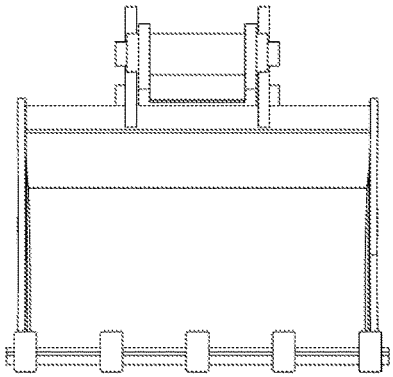
Figure 8B:
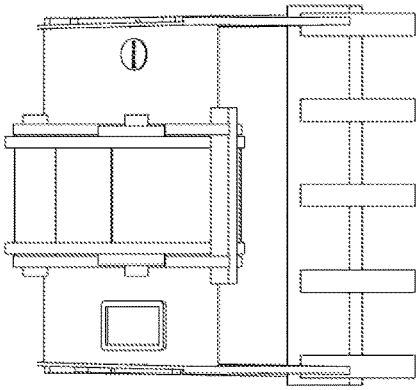
FIGS. 8A-8D are a perspective view, a top view, a front view and a side view, respectively, illustrating an excavator bucket including a mounting bracket cooperatively mounted on the coupler of the articulated arm, according to a first embodiment of the invention, in a reversed orientation compared to the prior art.
Figure 8A:
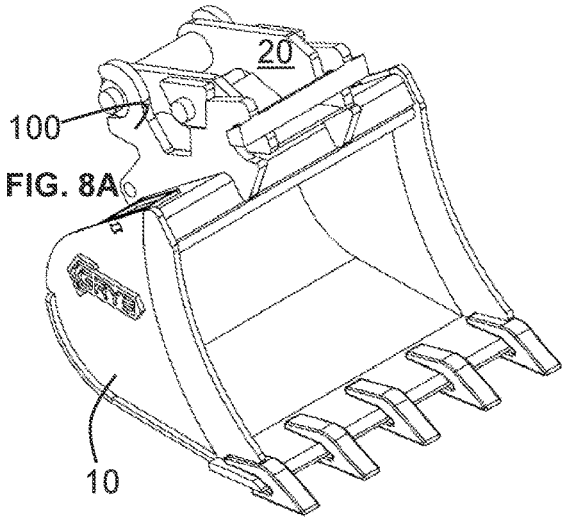
Figure 8D:
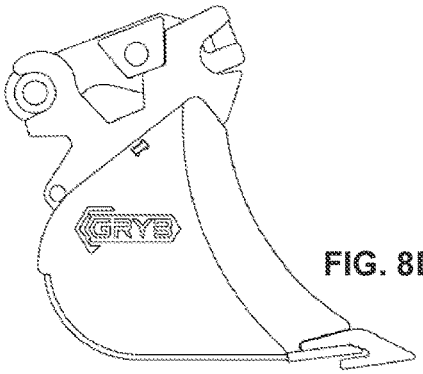
Figure 8C:
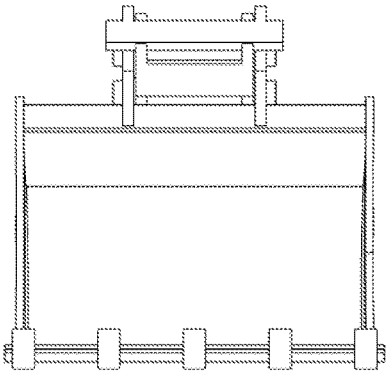

In addition to the second abutment edge 135 discussed above, this third concavity 150 makes the bracket 100 adapted to receive the coupler 20 in the standard orientation, as shown in FIGS. 3A and 7A, and further adapted to receive the coupler 20 in an orientation opposite the standard orientation, as shown in FIG. 8A.

The orientation opposite the standard orientation implies that the first concavity 120 receives the blocking bar 26, around which the bracket 100 does not hinge, contrarily to the hinge shaft 22. As discussed above, the first concavity 120 comprises a straight portion at an angle adapted for receiving the blocking bar 26.

This therefore makes the mounting bracket 100 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 100 allows two different and opposite orientations as shown in FIGS. 7A and 8A. The first or standard orientation is provided by having the coupler 20 lock with the first concavity 120, the straight portion 142 of the second concavity 140, and the first abutment edge 130, which respectively cooperate with the hinge shaft 22, with the blocking bar 26, and with the stopper 24. The second or reversed orientation is provided by having the coupler 20 lock with the third concavity 150, the straight portion 122 of the first concavity 120, and the second abutment edge 135, which also respectively cooperate with the hinge shaft 22, with the blocking bar 26, and with the stopper 24. If a different orientation is required for scraping with the bucket or for a specific application using the bucket, the mounting bracket 100 can provide the required adaptability.

Figure 9A:
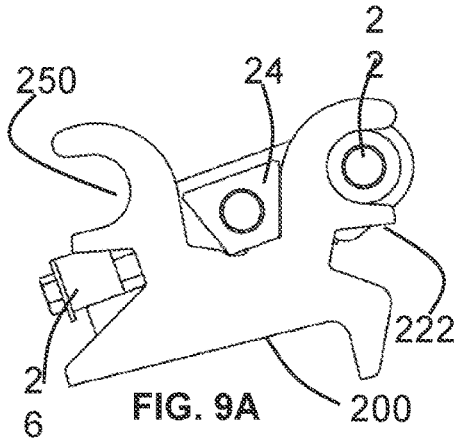
FIGS. 9A-9D are perspective views illustrating a mounting bracket cooperatively mounted on the coupler of the articulated arm, according to a second embodiment of the invention.

Now referring to FIGS. 9A-9F, there is shown another embodiment of a bracket 200. FIGS. 9A-9D show how the mounting bracket 200 can be arranged in two different positions with the coupler 20; FIG. 9E identifies clearly all parts of the mounting bracket 200, and FIG. 9F show that the mounting bracket 200 is normally provided in pair of parallel brackets.

The mounting bracket 200 comprises all the features of the mounting bracket 100' of the prior art. Therefore, the bracket 200 comprises a body 210 which forms the solid base of the bracket 100. The body 210 is shaped such as it comprises a first concavity 220 which is carved out from a side of the body in a concave fashion (i.e., carved toward a central portion of the body 210 such that it forms an outward opening) and which has an arc-of-circle shape conforms to a part of the cylindrical surface of the hinge shaft 22, which has a cylinder shape. This shape makes the first concavity, having its opening directed outwardly, suitable to receive the hinge shaft 22 of the coupler 20 and thereby act as a hinge shaft receiver.

Away from, the first concavity 220, the mounting bracket 200 comprises a fourth concavity 224 with a portion 222 that conforms with a portion of the surface of the blocking bar 26. The fourth concavity 224 does not need to have an arc-of-circle or otherwise rounded shape. The fourth concavity 224 needs to grossly conform with a portion of the surface of the blocking bar 26. According to an embodiment, the portion 222 that conforms with a portion of the surface of the blocking bar 26 is a straight portion within or at the edge of the fourth concavity 224. This straight portion has an angle that conforms with the surface of the blocking bar 26. Notably, it forms an angle that corresponds with an angle of the trapeze cross-section 27 of the blocking bar 26.

A second concavity 240 is carved out from the body 210 at a side thereof which is substantially opposite the first concavity 220 with respect to the central portion of the body 210. The second concavity 240 is concave, with the concavity directed toward the central portion of the body 210, and the opening thereof being thus directed outwardly. It does not need to have an arc-of-circle or otherwise rounded shape. The second concavity 240 needs to grossly conform with a portion of the surface of the blocking bar 26. Moreover, the second concavity 240 comprises a portion 242 that conforms with a portion of the surface of the blocking bar 26. According to an embodiment, the portion 242 that conforms with a portion of the surface of the blocking bar 26 is a straight portion, similar to the portion 222 of the fourth concavity 224, and as shown in FIG. 9E where the second concavity 240 comprises a straight portion 242. This straight portion has an angle that conforms with the surface of the blocking bar 26. Notably, it forms an angle that corresponds with an angle of the trapeze cross-section 27 of the blocking bar 26.

A first abutment edge 230 is provided by the central portion, where the body narrows down and offers a substantially flat edge on which the stopper 24 of the coupler 20 can abut when the mounting bracket is mounted on the coupler 20. The first abutment edge is provided in a hollow central portion 231 provided between the first and third concavities; this hollow central portion 231 is substantially symmetrical from a center thereof where a recess 238 is provided in the bottom of the hollow central portion 231. The hollow central portion 231 is for sticking the stopper 24 tightly thereinto, and holding it firmly in place, when the bracket 200 is mounted on the coupler 20 in any of the two orientations.

Moreover, and in addition to the prior art bracket 100', the bracket 200 comprises a second abutment edge 235. The second abutment edge 235 is shaped similarly as the first abutment edge 230 and is located at a position which is close to the first abutment edge 230, opposite the central portion of the body 210, where the small recess 238 is provided. Both abutment edges should be substantially provided symmetrically, in mirror, about the recess 238 which is centrally located between the concavities 220, 224 on one side, and the concavities 250, 240 on the other side. The second abutment edge 235 is located at an angle with respect to the longitudinal or horizontal axis of the mounting bracket 200, and the first abutment edge 230 is also provided with a similar angle but mirrored from the center of the body 210, such as forming two facing slopes with the small recess 238 in the middle. The second abutment edge 235 is suited to receive the stopper 24 of the coupler 20. More precisely, while the first abutment edge 230 is adapted to receive a first edge of the stopper 24, the second abutment edge 235 it adapted to receive a second edge of the stopper 24 which is located opposite the first edge of the stopper with respect to a central portion of the stopper 24 (i.e., the recess 238). The recess 238, or a portion close thereto, further receives another corner of the stopper 24 and thus aids in blocking the coupler 20 and the bracket 200 altogether. This facing dual-slope shape on the body 210 of the bracket 200 makes the bracket 200 adapted to receive the coupler 20 in the standard orientation, as shown in FIGS. 9A-9B, and further adapted to receive the coupler 20 in an orientation opposite the standard orientation, as shown in FIGS. 9C-9D.

Moreover, and in addition to the prior art bracket 100', the bracket 200 comprises a third concavity 250. The third concavity 250 should be of a shape substantially similar to the first concavity 220, since the straight portion at an angle adapted for receiving the blocking bar 26 is not required for the third concavity 250. The third concavity 250 should be located approximately opposite the first concavity 220 on the mounting bracket 200, and thus be located very close to the second concavity 240. According to an embodiment, the third concavity should be provided above the second concavity 240 if the first abutment edge 230 and the second abutment edge 235 are also located above the central portion of the body 210, as shown in FIG. 9E.

By having a shape substantially similar to the first concavity 220, with an arc-of-circle shape conforms to a part of the cylindrical surface of the hinge shaft 22, the third concavity 250 can conform to a part of the cylindrical surface of the hinge shaft 22, which has a cylinder shape. This shape makes the third concavity suitable to receive the hinge shaft 22 of the coupler 20 and thereby act as a hinge shaft receiver, as for the first concavity 220.

Figure 9B:
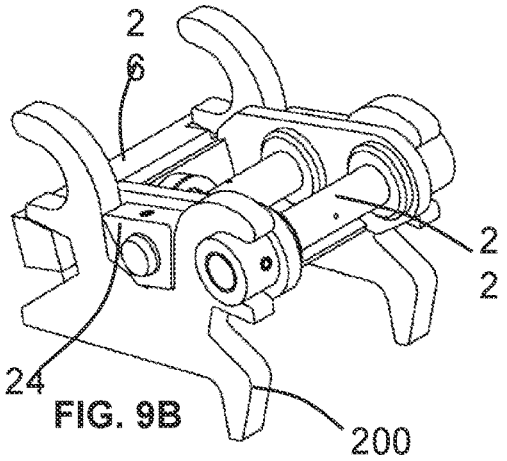
Figure 9C:
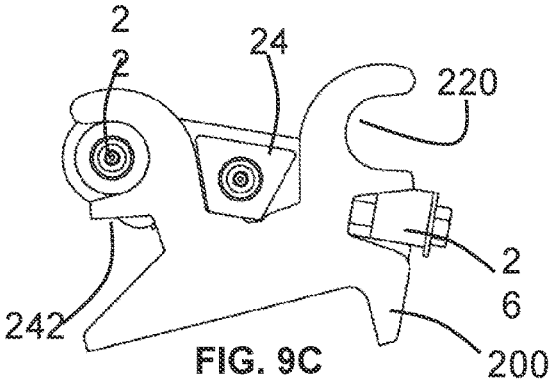
Figure 9D:
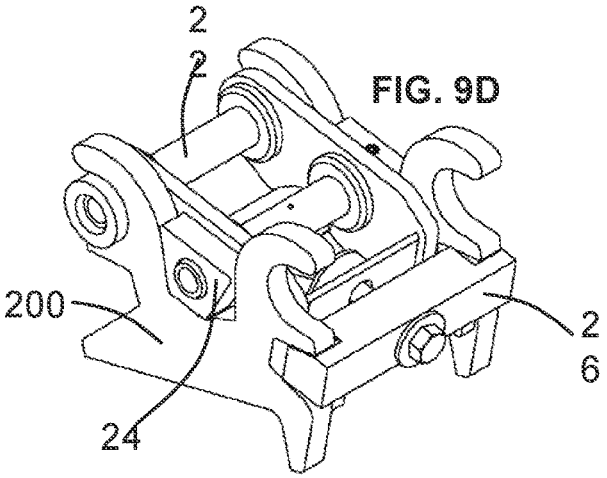

In addition to the second abutment edge 235 discussed above, this third concavity 250 makes the bracket 200 adapted to receive the coupler 20 in the standard orientation, as shown in FIGS. 9A-9B, and further adapted to receive the coupler 20 in an orientation opposite the standard orientation, as shown in FIGS. 9C-9D.

The orientation opposite the standard orientation implies that the first concavity 220 receives the blocking bar 26, around which the bracket 200 does not hinge, contrarily to the hinge shaft 22. As discussed above, the fourth concavity 224 comprises a straight portion 222 at an angle adapted for receiving the blocking bar 26.

This therefore makes the mounting bracket 200 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 200 allows two different and opposite orientations as shown in FIGS. 97A-9B and 9C-9D. The first or standard orientation is provided by having the coupler 20 lock with the first concavity 220, the straight portion 242 of the second concavity 240, and the first abutment edge 230, which respectively cooperate with the hinge shaft 22, with the blocking bar 26, and with the stopper 24. The second or reversed orientation is provided by having the coupler 20 lock with the third concavity 250, the straight portion 222 of the first concavity 220, and the second abutment edge 235, which also respectively cooperate with the hinge shaft 22, with the blocking bar 26, and with the stopper 24. If a different orientation is required for scraping with the bucket or for a specific application using the bucket, the mounting bracket 200 can provide the required adaptability.

The embodiment of the mounting bracket 200 is further advantageous, in comparison with the first embodiment of the mounting bracket 100, in that when the stopper 24 generally abuts on the first abutment edge 230, it is further held in place by having another otherwise non-abutting corner thereof being stuck in place tightly by the second abutting edge 235. Similarly, when the stopper 24 generally abuts on the second abutment edge 235, it is further held in place tightly by having another otherwise non-abutting corner thereof being stuck in place by the first abutting edge 230. The mounting bracket 200 and the coupler 20 are therefore held in place particularly firmly, which is more secure overall.

Figure 10A:
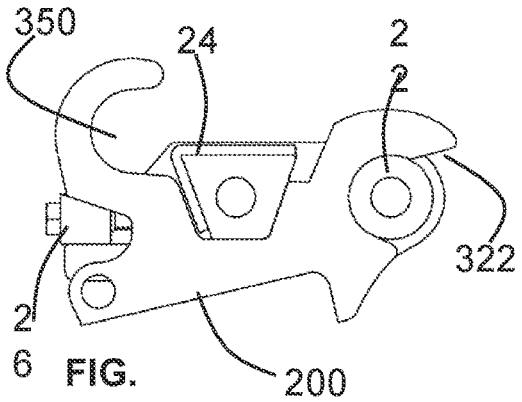
FIGS. 10A-10D are perspective views illustrating a mounting bracket cooperatively mounted on the coupler of the articulated arm, according to a third embodiment of the invention.
Figure 10B:
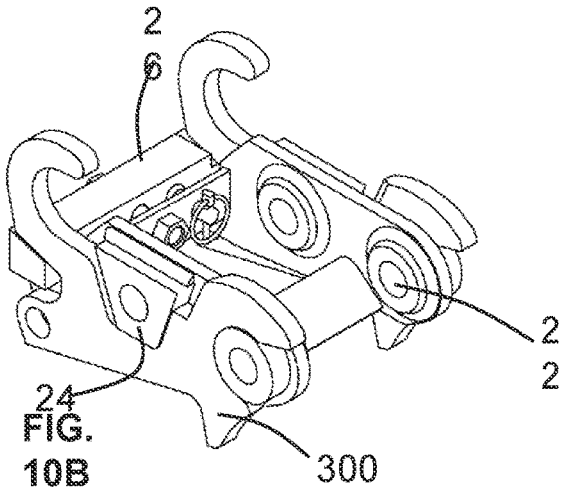
Figure 10C:
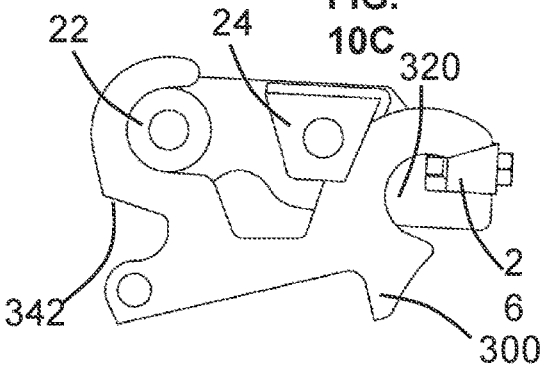
Figure 10D:
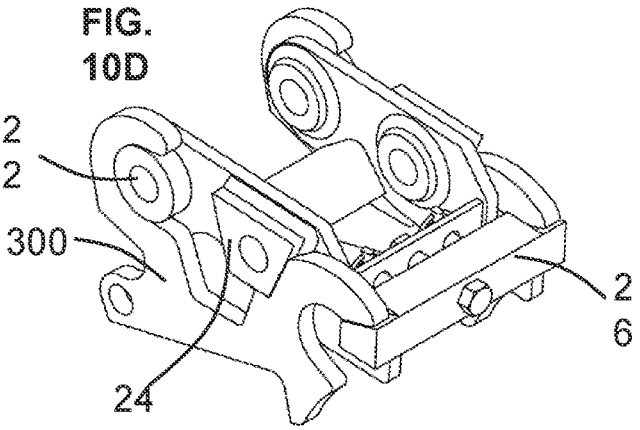
Figure 10E:
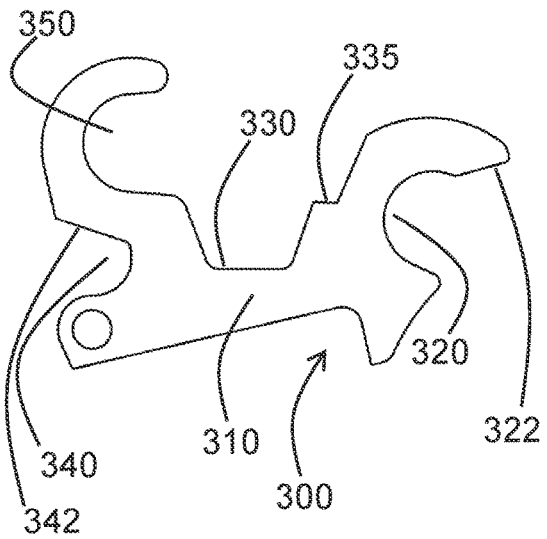
FIGS. 10E-10F are a perspective view and a side view of the mounting bracket of FIGS. 9A-9D.
Figure 10F:
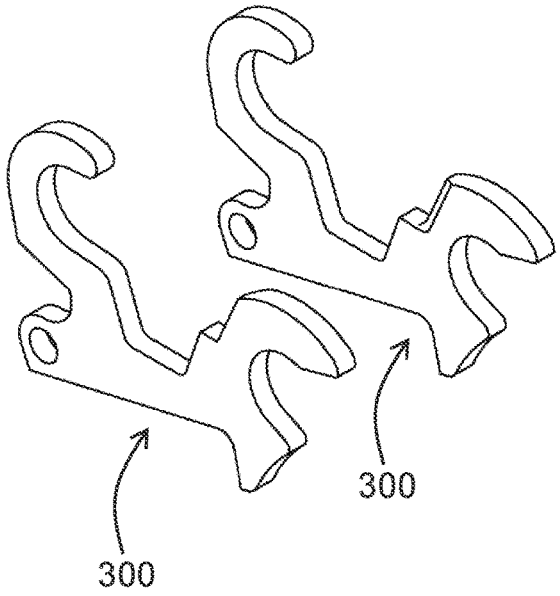

Now referring to FIGS. 10A-10F, there is shown another embodiment of a bracket 300. FIGS. 10A-10D show how the mounting bracket 300 can be arranged in two different positions with the coupler 20; FIG. 10E identifies clearly all parts of the mounting bracket 300, and FIG. 10F show that the mounting bracket 200 is normally provided in pair of parallel brackets.

The mounting bracket 300 is similar to the mounting bracket 100 described above. The bracket 300 comprises a body 310 which forms the solid base of the bracket 300. The body 310 is shaped such as it comprises a first concavity 320 which is carved out from a side of the body in a concave fashion (i.e., carved from the outside toward a central portion of the body 310 such that the first concavity 320 forms an opening that is directed outwardly) and which an arc-of-circle shape conforms to a part of the cylindrical surface of the hinge shaft 22, which has a cylinder shape. This shape makes the first concavity suitable to receive the hinge shaft 22 of the coupler 20 and thereby act as a hinge shaft receiver. Moreover, the first concavity 320 comprises a portion 322 that conforms with a portion of the surface of the blocking bar 26. According to an embodiment, the portion 322 that conforms with a portion of the surface of the blocking bar 26 is a straight portion within or at the edge of the portion otherwise shaped as an arc of circle. In the embodiment as shown in FIG. 10E, the arc-of-circle portion ends with the straight portion 322. This straight portion 322 can be at the upper edge of the portion shaped as an arc of circle, where the arc of circle ends with, or is continued by, the straight portion. This straight portion has an angle that conforms with the surface of the blocking bar 26. Notably, it forms an angle that corresponds with an angle of the trapeze cross-section 27 of the blocking bar 26.

A second concavity 340 is carved out from the body 310 at a side thereof which is substantially opposite the first concavity 320 with respect to the central portion of the body 310. The second concavity 340 is concave toward the central portion of the body 310. It does not need to have an arc-of-circle or otherwise rounded shape. The second concavity 340 needs to grossly conform with a portion of the surface of the blocking bar 26. Moreover, the second concavity 340 comprises a portion 342 that conforms with a portion of the surface of the blocking bar 26. According to an embodiment, the portion 342 that conforms with a portion of the surface of the blocking bar 26 is a straight portion, similar to that of the first concavity 310, and as shown in FIG. 10E where the second concavity 340 comprises a straight portion 342. This straight portion has an angle that conforms with the surface of the blocking bar 26. Notably, it forms an angle that corresponds with an angle of the trapeze cross-section 27 of the blocking bar 26.

A first abutment edge 330 is provided by the central portion, where the body narrows down and offers a substantially flat edge on which the stopper 24 of the coupler 20 can abut when the mounting bracket is mounted on the coupler 20.

Moreover, and in addition to the prior art bracket 100', the bracket 300 comprises a second abutment edge 335. The second abutment edge 335 is shaped similarly as the first abutment edge 330 and is located at a position which is close to the first abutment edge 330. Both should be substantially parallel. The second abutment edge 335 is located at a different level compared to the first abutment edge 330, such as forming two steps. According to an embodiment, the second abutment edge 335 is located aside the first abutment edge 330 and further from the central portion of the body 310, thus forming the two-step stair. The second abutment edge 335 is suited to receive the stopper 24 of the coupler 20. More precisely, while the first abutment edge 330 is adapted to receive a first edge of the stopper 24, the second abutment edge 335 it adapted to receive a second edge of the stopper 24 which is located opposite the first edge of the stopper with respect to a central portion of the stopper 24. This two-stair shape on the body 310 of the bracket 300 makes the bracket 300 adapted to receive the coupler 20 in the standard orientation, as shown in FIGS. 10A-10B, and further adapted to receive the coupler 20 in an orientation opposite the standard orientation, as shown in FIGS. 10C-10D.

Moreover, and in addition to the prior art bracket 100', the bracket 300 comprises a third concavity 350. The third concavity 350 should be of a shape substantially similar to the first concavity 320, or to the prior art first concavity 120' since the straight portion at an angle adapted for receiving the blocking bar 26 is not required for the third concavity 150. The third concavity 350 should be located approximately opposite the first concavity 320 with respect to the first concavity 320, and thus be located very close to the second concavity 340. According to an embodiment, the third concavity should be provided above the second concavity if the first abutment edge 330 and the second abutment edge 335 are also located above the central portion of the body 310, as shown in FIG. 10E.

By having a shape substantially similar to the first concavity 320, with an arc-of-circle shape conforms to a part of the cylindrical surface of the hinge shaft 22, the third concavity 350 can conform to a part of the cylindrical surface of the hinge shaft 22, which has a cylinder shape. This shape makes the third concavity 350 suitable to receive the hinge shaft 22 of the coupler 20 and thereby act as a hinge shaft receiver, as for the first concavity 320.

Contrarily to the first embodiment of the mounting bracket 100 where the third concavity 150 had an opening that was oriented outwardly, away from the central portion of the body 110, the third concavity 350 of the mounting bracket 300 has an opening directed inwardly, toward the first concavity 320. The orientation of both the third concavity 350 and the first concavity 320 are therefore very similar. The third concavity 350 of the mounting bracket 300 is therefore mirrored when compared to the third concavity 150 of the mounting bracket 100 (and this is the only element being mirrored since all other elements are arranged the same way as the first embodiment of the mounting bracket 100).

In addition to the second abutment edge 335 discussed above, this third concavity 350 makes the bracket 300 adapted to receive the coupler 20 in the standard orientation, as shown in FIGS. 10A-10B, and further adapted to receive the coupler 20 in an orientation opposite the standard orientation, as shown in FIG. 10C-10D.

The orientation opposite the standard orientation implies that the first concavity 320 receives the blocking bar 26, around which the bracket 300 does not hinge, contrarily to the hinge shaft 22. As discussed above, the first concavity 320 comprises a straight portion at an angle adapted for receiving the blocking bar 26.

This therefore makes the mounting bracket 300 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 300 allows two different and opposite orientations as shown in FIGS. 10A-10B and 10C-10D. The first or standard orientation is provided by having the coupler 20 lock with the first concavity 320, the straight portion 342 of the second concavity 340, and the first abutment edge 330, which respectively cooperate with the hinge shaft 22, with the blocking bar 26, and with the stopper 24. The second or reversed orientation is provided by having the coupler 20 lock with the third concavity 350, the straight portion 322 of the first concavity 320, and the second abutment edge 335, which also respectively cooperate with the hinge shaft 22, with the blocking bar 26, and with the stopper 24. If a different orientation is required for scraping with the bucket or for a specific application using the bucket, the mounting bracket 300 can provide the required adaptability.

Combinations between the second and third embodiments can also be contemplated, such that the third concavity 250 of the mounting bracket 200 can be mirrored in a way similar to the third concavity 350 of the mounting bracket 300, thus being open inwardly instead of outwardly.

Reference is now made to another embodiment, as shown in FIGS. 11A-15C.

Figure 11A:
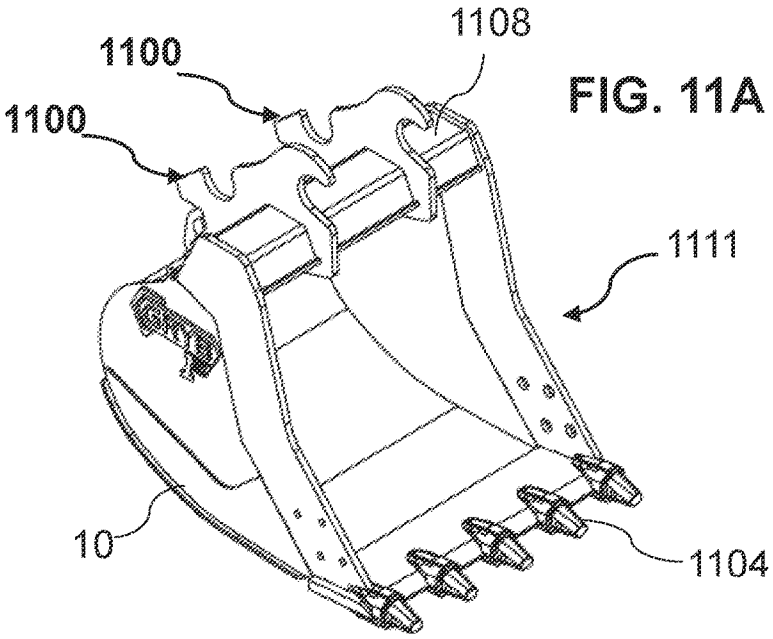
FIGS. 11A-11D are a perspective view, a top view, a front view and a side view, respectively, illustrating an excavator bucket including a mounting bracket, in the standard orientation, according to a fourth embodiment.
Figure 11B:
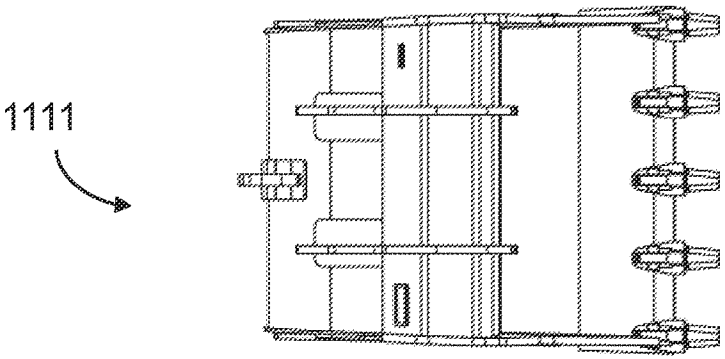
Figure 11C:
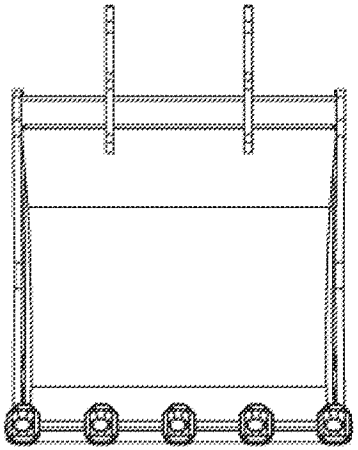
Figure 11D:
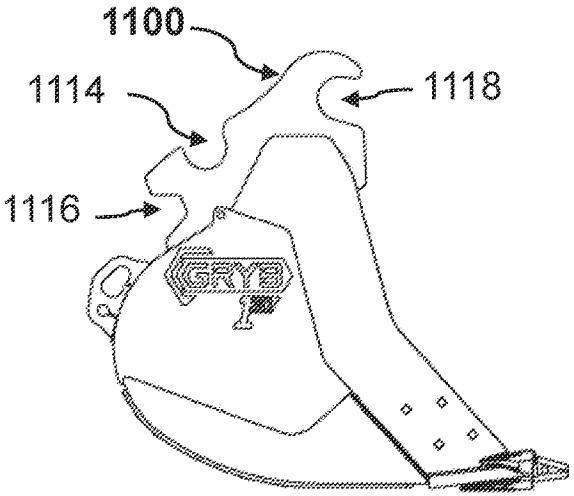

This other embodiment comprises a bucket assembly 1111, where a bucket 10, as shown for example in FIG. 11A, is assembled with a bracket 1100 according to another embodiment.

Figure 14A:
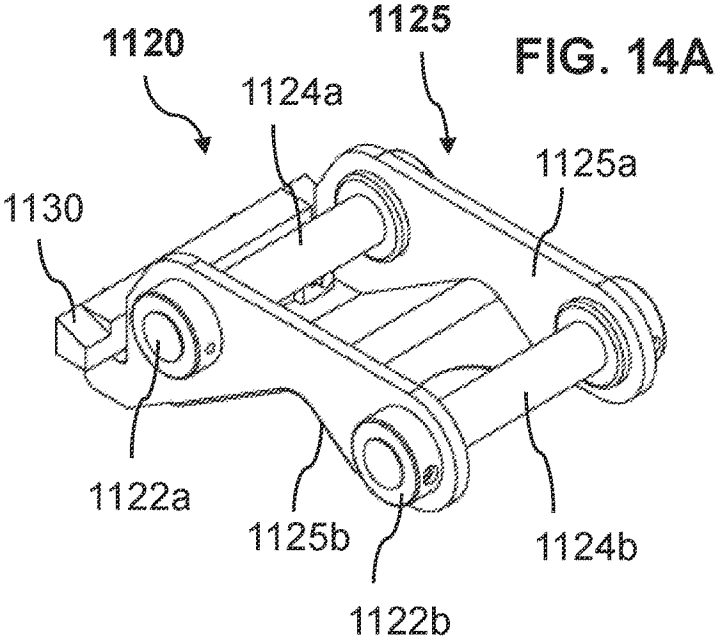
FIGS. 14A-14C are a perspective view, a top view and a side view, respectively, illustrating a coupler of the articulated arm, according to an embodiment.
Figure 14B:
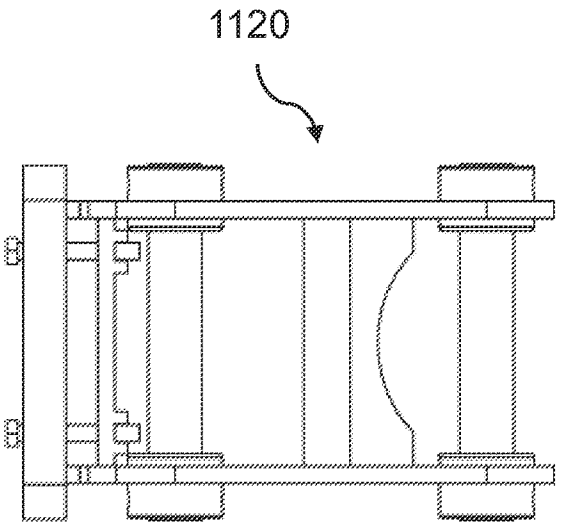
Figure 14C:
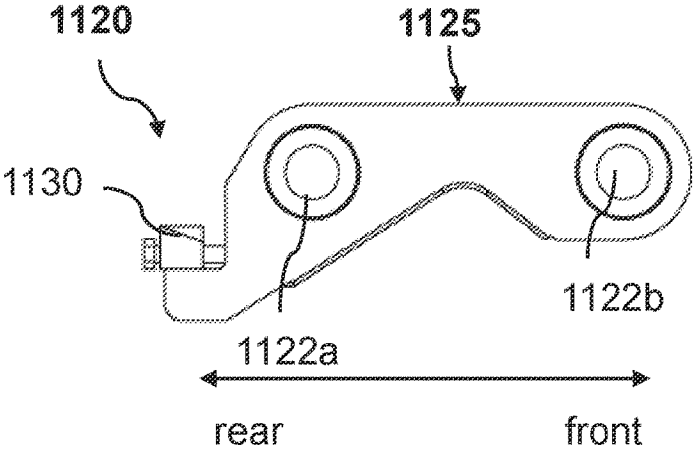
Figure 15A:
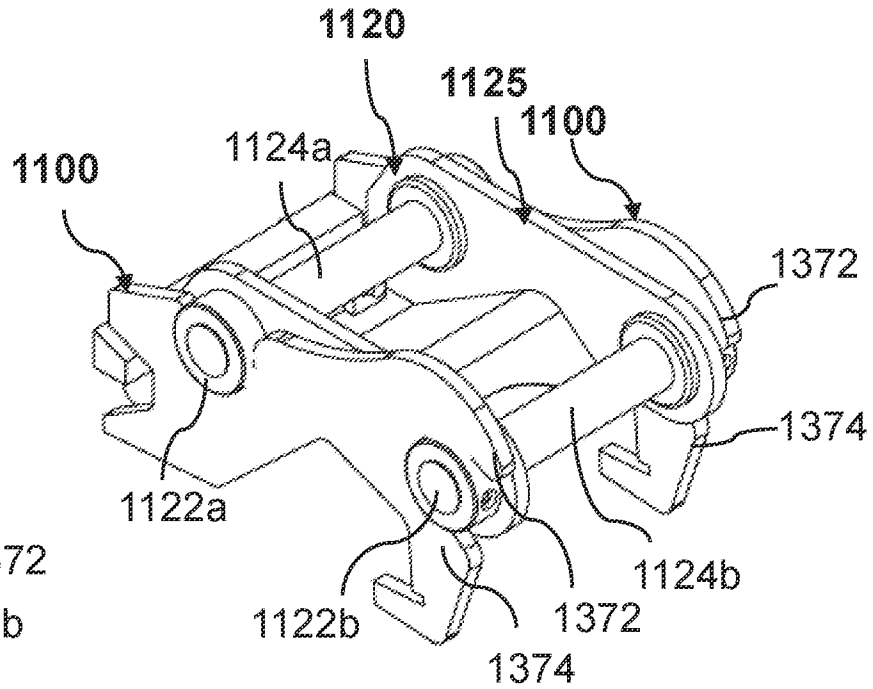
FIGS. 15A-15C are a perspective view, a top view and a side view, respectively, illustrating a mounting bracket cooperatively mounted on the coupler of the articulated arm, in the standard orientation, according to a fourth embodiment.
Figure 15B:
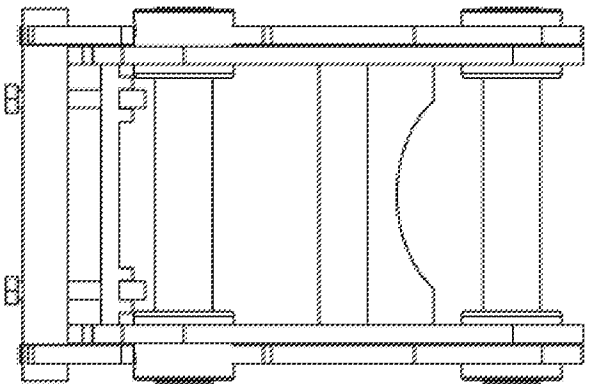
Figure 15C:
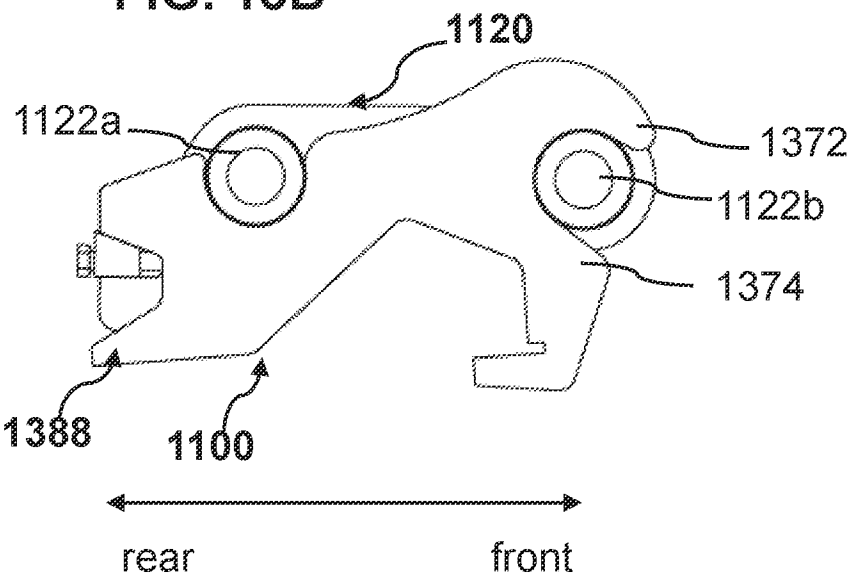

The coupler 1120 is shown in FIGS. 14A-14C and also in FIGS. 15A-15C, and is different from the coupler 20 described in reference with the previous embodiment (that coupler 20 being standard as already described above). The coupler 1120 is shown in FIGS. 14A-14C and also in FIGS. 15A-15C in a bucket assembly 1111 with the bucket 10 according to the invention as described below. The coupler 1120 comprises a body 1125 which may comprise a pair of parallel arms 1125*a*, 1125*b* (on the right side and left side), for example, as shown in FIG. 14A where the body is formed by two parallel elongated plates (i.e., arms 1125*a*, 1125*b*) forming each side (right and left) or flanges of the body 1125.

Each of these side arms 1125*a*, 1125*b* comprises stoppers 1122*a* in the rear on either side (right and left) and stoppers 1122*b* in the front of the coupler 1120 on either side thereof (right and left). Each stopper 1122*a*, 1122*b* protrudes outwardly on the sides of the coupler 1120 (i.e., protruding toward the outside, from the side arms of the body 1125) and provides a curved surface or edge for abutting onto a corresponding curved location on the bracket 1100 having a complementary shape and to block or confine movement. Contrarily to the coupler 20 described above in reference to a previous embodiment, the cross-section of the stopper 1122*a*, 1122*b* has a circular shape to fit in a corresponding concavity of corresponding radius of curvature (i.e., about the same radius of curvature, plus a mechanical tolerance for fitting).

Corresponding right and left stoppers 1122*a* at the rear have a rear linking rod or hinge shaft 1124*a* in-between which holds the side arms 1125*a*, 1125*b* together and links the right and left stoppers 1122*a* at the rear of the coupler 1120. Similarly, corresponding right and left stoppers 1122*b* at the front have a linking rod or hinge shaft 1124*b* in-between which also holds the side arms 1125*a*, 1125*b* together and links the right and left stoppers 1122*b* at the front of the coupler 1120.

The hinge shaft 1124*a* or 1124*b* is a cylinder around which the bracket 10 can hinge. The hinge shafts 1124*a* and 1124*b* are cylindrical to provide rotatability around any one of them. At a rear of the coupler 1120 with respect to a central portion of the coupler 1120 (i.e., opposite the rear stoppers 1122*b*), the coupler comprises a blocking bar 1130 which extends parallel to both shafts 1124*a* and 1124*b* (which are also parallel) and which contribute to securing the bracket 10 to the coupler 1120, along with the hinge shafts 1124*a* and 1124*b* and the pairs of opposed stoppers 1122*a*, 1122*b*.

Circular cavities described further below in relation with FIGS. 11A-21C are made to fit with the circular stoppers 1122*a*, 1122*b* of the coupler 1120 (or alternatively with a surface of a hinge shaft of the coupler).

Now referring to FIGS. 11A-12D, there is shown a bucket 10 onto which there is secured a mounting bracket 1100, forming a bucket assembly 1111.

Figure 13A:
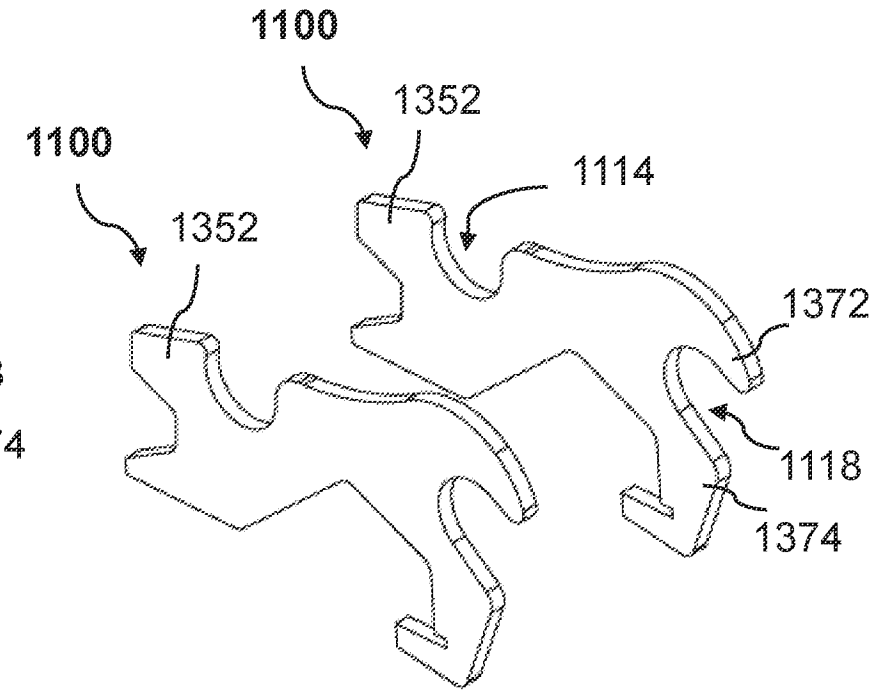
FIGS. 13A-13B are a side and a perspective view illustrating a mounting bracket, according to a fourth embodiment.
Figure 13B:
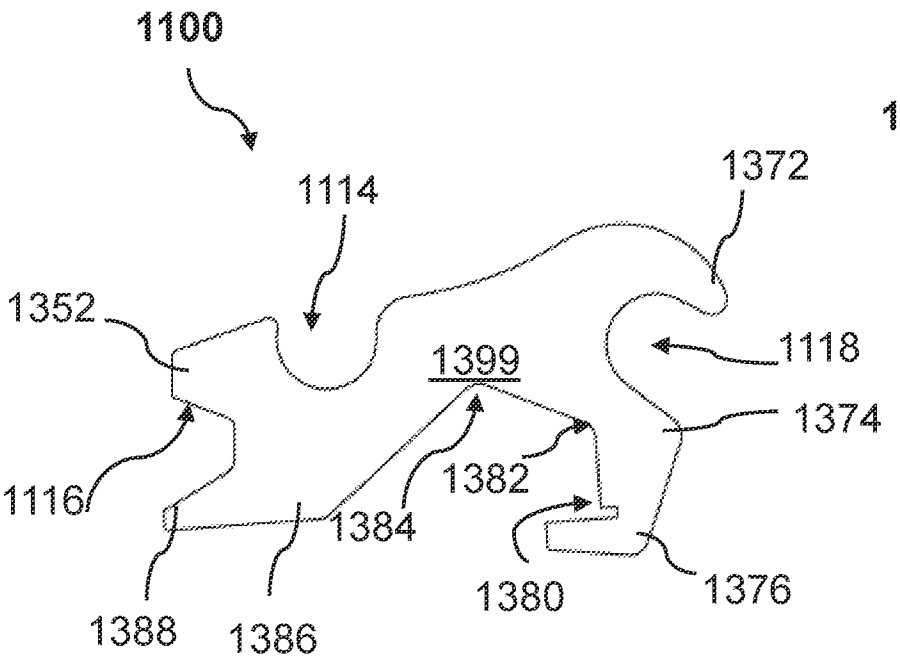

FIG. 13B identifies all parts of the mounting bracket 1100, and FIG. 13A shows that the mounting bracket 1100 is normally provided in pair of identical parallel brackets. The coupling with the coupler 1120 described above is shown in FIGS. 15A-15C. The mounting bracket 1100 and the coupler 1120 mounted together are used in a given configuration which connects the bucket 10 to the articulated arm in a single orientation.

The single, standard orientation (configuration of FIGS. 11A-12D or FIGS. 15A-15C) is provided by having the stoppers 1122*a*, 1122*b* of the hinge shafts of the coupler 1120 lock with the rear upward cavity 1114 and the front frontward cavity 118, and the blocking bar 1130 lock with the abutment 1116, as described below.

As well shown in FIG. 13B, the bracket 1100 comprises a body 1399 which forms the solid base of the bracket 1100. The body 1399 is shaped such that it comprises at the rear: a rear upward concavity 1114, formed in a rear portion (which can be a protrusion at a rear protruding upwardly), and a front frontward concavity 1118, formed between a front arm 1372 protruding forwardly and a downward arm 1376 protruding substantially downwardly and having a base 1374.

To achieve the standard configuration, the rear upward cavity 1114 is paired with the front frontward cavity 118 to receive corresponding hinge shafts 1124*a*, 1124*b*, respectively, and they are distant with the same distance as between the hinge shafts 1124*a*, 1124*b* of the coupler 1120, as shown in FIG. 15A. The cavities have an arc-of-circle shape that conforms to a part of the cylindrical surface of this hinge shaft 1124*a* or 1124*b* (which have a cylinder shape).

Still to achieve this standard configuration (and referring to FIGS. 13B, 15A, 15C): away from the front frontward cavity 118, at the rear of the mounting bracket 1100, the body is shaped to form an abutment 1116 formed below the rear upward arm 1352, that conforms with a portion of the surface of the blocking bar 1130. The abutment 1116 needs to grossly conform with a portion of the surface of the blocking bar 1130. A spur 1388 may further define a concavity comprising the abutment 1616 and also conform at the bottom of the spur 1388 with the bucket 10.

To ensure that the coupler 1120 is snuggly or firmly held by the mounting bracket 1100 in the standard configuration, the centroid of the body 1399 forming the mounting bracket 1100 should be found approximately between the front frontward cavity 118 and the abutment 1116 (which are opposed to each other with respect to said centroid). The reference number 1399 of the body is approximately located at a centroid in FIG. 13B.

Figure 12A:
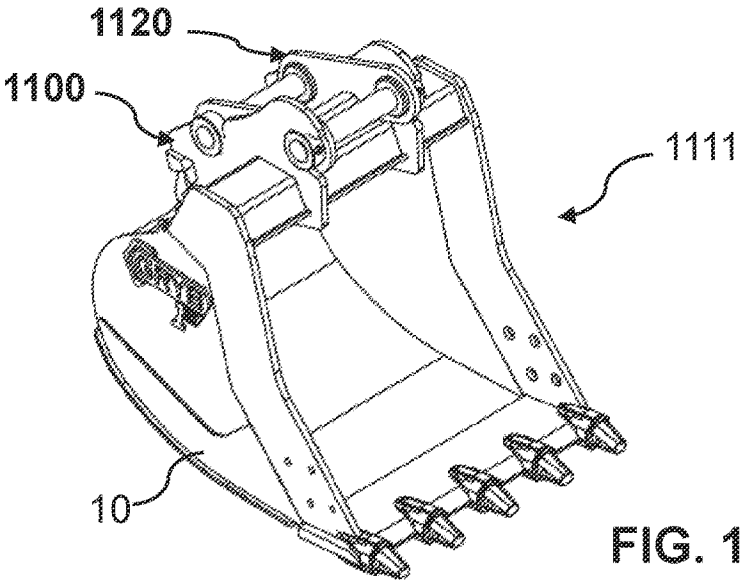
FIGS. 12A-12D are a perspective view, a top view, a front view and a side view, respectively, illustrating an excavator bucket including a mounting bracket cooperatively mounted on the coupler of the articulated arm, in the standard orientation, according to a fourth embodiment.
Figure 12C:
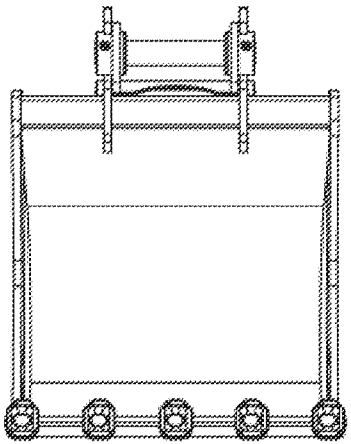
Figure 12B:
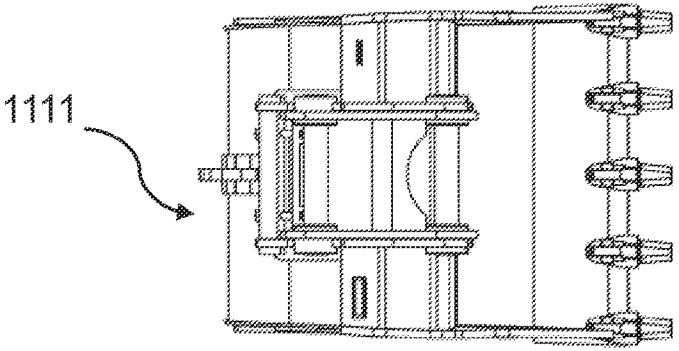
Figure 12D:
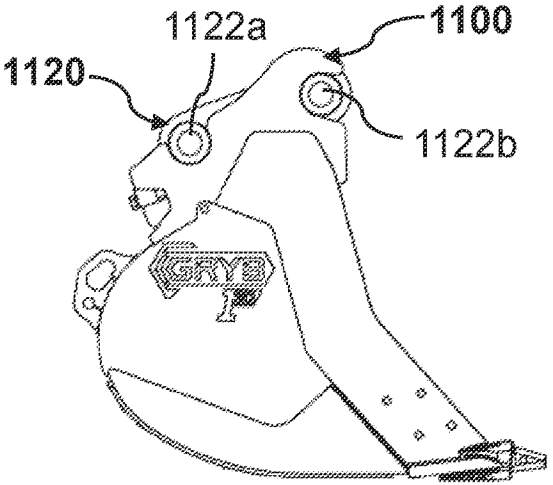

According to an embodiment, the body also comprises a notch 1380 formed by the downward arm 1376 that conforms to an edge 1108 of the bucket 10 to be assembled with the mounting bracket 1100, as shown in FIG. 11A or 12A. A bottom edge 1386 and bottom corners 1382, 1384 further contribute to fitting the bottom of the mounting bracket 1120 with the edge 1108 of the bucket 10.

The embodiment of the mounting bracket 1120 is advantageous in that there are three points of contact which ensure that the mounting bracket 1100 and the coupler 1120 can lock together when configured so. The mounting bracket 1100 and the coupler 1120 are therefore held in place particularly firmly, which is more secure overall.

Now referring to FIGS. 16A-21C, there is shown another embodiment of a bracket 1610. FIGS. 17A-17D or FIGS. 20A-20C (first configuration), compared to FIGS. 18A-18D or FIGS. 21A-21C (second, reversed configuration) show how the mounting bracket 1610 can be arranged in two different positions with the coupler 1120. This other embodiment comprises a bucket assembly 1611, where a bucket 10 is assembled with a bracket 1610 according to another embodiment.

Figure 19A:
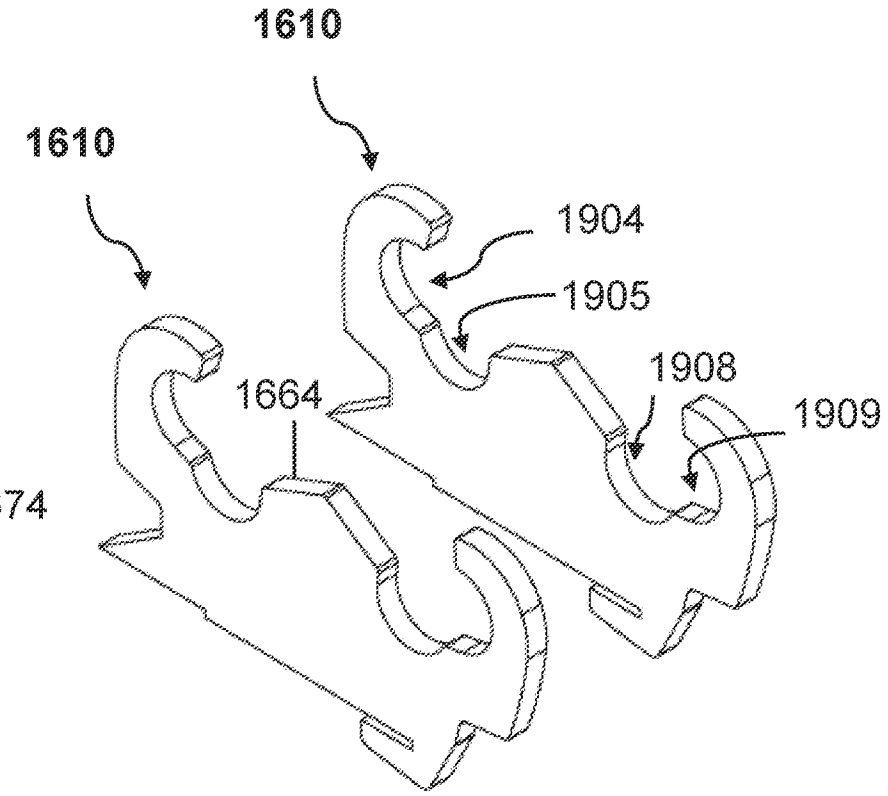
FIGS. 19A-19B are a side and a perspective view illustrating a mounting bracket, according to a fifth embodiment.
Figure 19B:
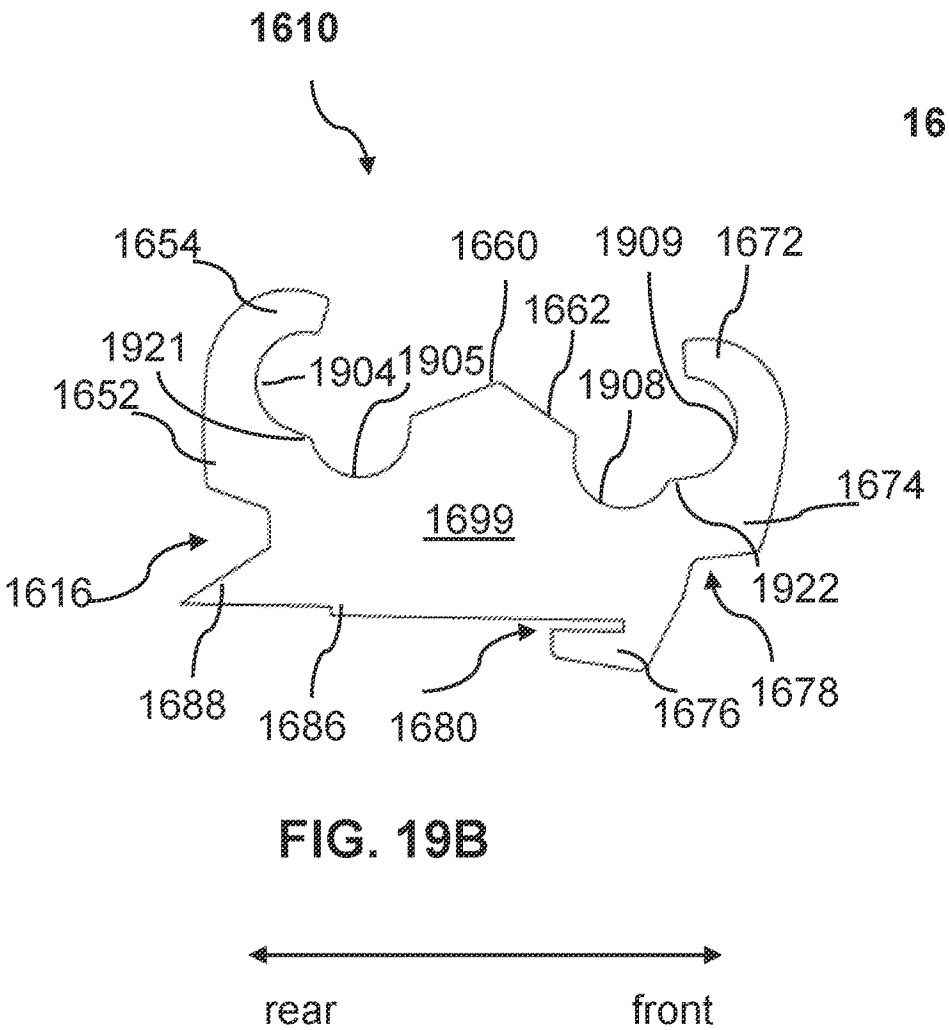
Figure 20A:
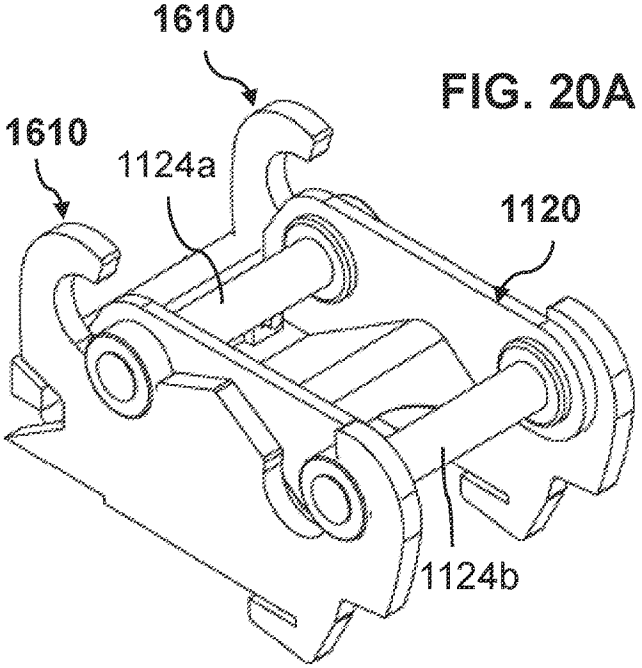
FIGS. 20A-20C are a perspective view, a top view and a side view, respectively, illustrating a mounting bracket cooperatively mounted on the coupler of the articulated arm, in the standard orientation, according to a fifth embodiment.
Figure 20B:
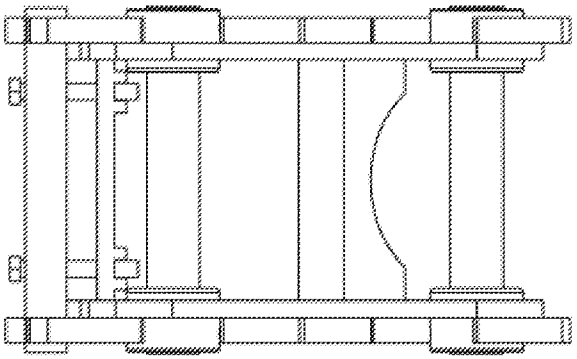
Figure 20C:
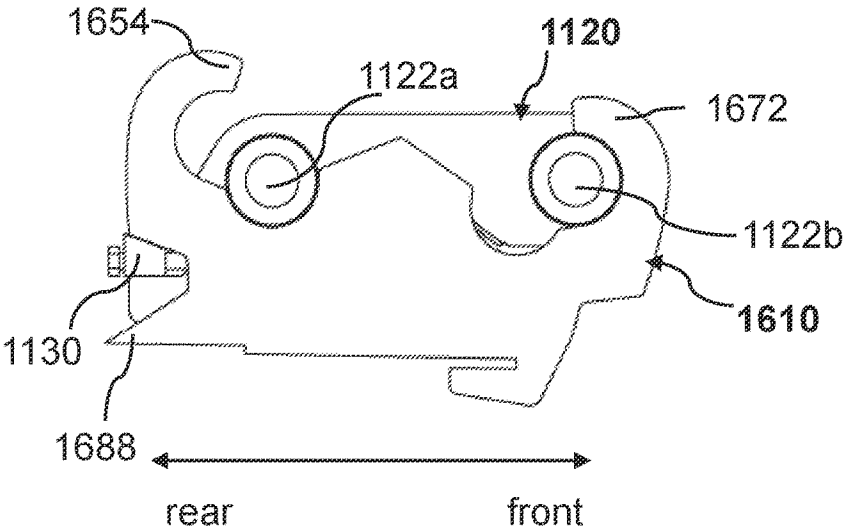

FIG. 19B identifies all parts of the mounting bracket 1610, and FIG. 19A shows that the mounting bracket 1610 is normally provided in pair of identical parallel brackets.

According to an embodiment of the invention, the mounting bracket 1610 can be reversibly mounted on the coupler 1120 to allow using the bucket 10 in two different orientations with respect to the articulated arm (i.e., reversible to allow two opposite configurations of the bucket on the articulated arm). This ensures that the bucket can be used in the most suitable orientation (e.g., upward or downward) for a given application. More particularly, as will be understood below, the mounting bracket can allow the bucket 10 to be mounted in a standard orientation, as discussion above in relation with the prior art, or in a reversed orientation. The first or standard orientation (first configuration of FIGS. 17A-17D or FIGS. 20A-20C) is provided by having the coupler 1120 lock with the rearward pair of cavities 1904 and 1905. The second or reversed orientation (second configuration of FIGS. 18A-18D or FIGS. 21A-21C) is provided by having the coupler 1120 lock with the frontward pair of cavities 1908 and 1909.

As well shown in FIG. 19B, the bracket 1610 comprises a body 1699 which forms the solid base of the bracket 1610. The body 1699 is shaped such that it comprises at the rear: a first rearward concavity 1904 (the most rearward one), formed in a rear portion (which can be an arm and having its concavity oriented toward the front), and a second rearward concavity 1905 (which is frontward compared to the first rearward concavity 1904), formed in the body 1699 closer to the centroid and having its concavity oriented upwardly; and at the front: a first frontward concavity 1908 (the most rearward one at the front), formed in the body 1699 closer to the centroid and having its concavity oriented upwardly, and a second frontward concavity 1909 (which is frontward compared to the first frontward concavity 1908 and also the most frontward of all), formed in a front portion (which can be an arm and having its concavity oriented toward the rear).

More specifically, the body 1699 is shaped such that it comprises the first rearward concavity 1904 which is carved out from a peripheric rear portion of the body in a concave fashion (i.e., carved rearwardly toward a periphery of the body 1699 such that it forms a frontward opening) and which has an arc-of-circle shape that conforms to a part of the cylindrical surface of the front hinge shaft 1124*b* in reverse configuration, which has a cylinder shape. This shape makes the first rearward concavity, having its opening directed frontwardly, suitable to receive the hinge shaft 1124*b* of the coupler 1120 and thereby act as a hinge shaft receiver, as well shown in FIG. 21A (reverse configuration). Similarly, the second frontward concavity 1909 is carved out from a peripheric front portion of the body in a concave fashion (i.e., carved rearwardly toward a periphery of the body 1699 such that it forms a rearward opening) and which has an arc-of-circle shape that conforms to a part of the cylindrical surface of the same front hinge shaft 1124*b* (which has a cylinder shape), but in standard configuration. This shape makes the first rearward concavity, having its opening directed rearwardly, suitable to receive the hinge shaft 1124*b* of the coupler 1120 and thereby act as a hinge shaft receiver, as well shown in FIG. 20A (standard configuration).

Figure 21A:
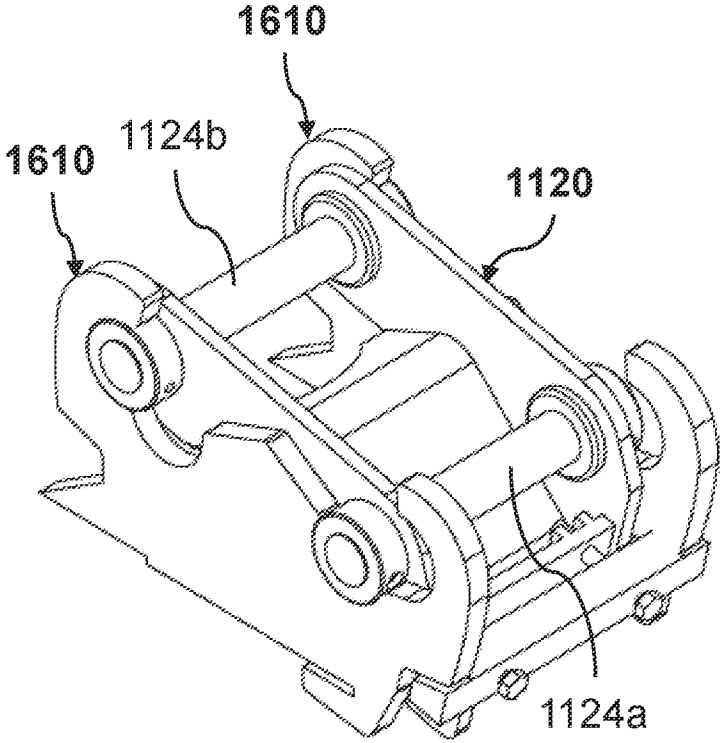
FIGS. 21A-21C are a perspective view, a top view and a side view, respectively, illustrating a mounting bracket cooperatively mounted on the coupler of the articulated arm, in the reverse orientation, according to a fifth embodiment.
Figure 21B:
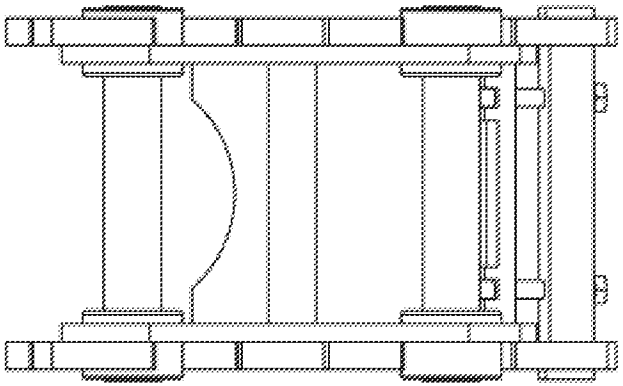
Figure 21C:
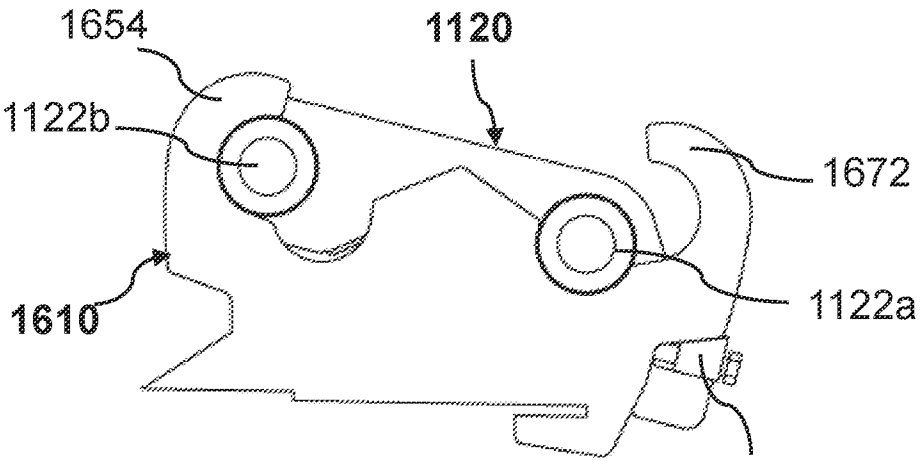

To achieve the reverse configuration, the first rearward concavity 1904 pairs with the first frontward concavity 1908 shown in FIG. 19B, and they are distant with the same distance as between the hinge shafts 1124*a*, 1124*b* of the coupler 1120, as shown in FIG. 21A. The first frontward concavity 1908 receives the other hinge shaft 1124*a* and has an arc-of-circle shape that conforms to a part of the cylindrical surface of this hinge shaft 1124*a* (which has a cylinder shape).

Still to achieve this reverse configuration (and referring to FIGS. 18D, 21A, 21C): away from the first rearward concavity 1904, at the front of the mounting bracket 1610, the body is shaped to form an abutment 1678 that conforms with a portion of the surface of the blocking bar 1130. The abutment 1678 needs to grossly conform with a portion of the surface of the blocking bar 1130. It can be formed by having an upward front arm 1672 with an arm base 1674 protrude frontwardly in front of the body 1699 of the mounting bracket 1610. It can be the same arm 1672 within which the second frontward concavity 1909 is carved (i.e., the peripheric front portion of the body).

To achieve the standard configuration, the second frontward concavity 1909 pairs with the second rearward concavity 1905 shown in FIG. 19B, and they are distant with the same distance as between the hinge shafts 1124*a*, 1124*b* of the coupler 1120, as shown in FIG. 21A. The second rearward concavity 1905 receives the other hinge shaft 1124*a* and has an arc-of-circle shape that conforms to a part of the cylindrical surface of this hinge shaft 1124*a* (which has a cylinder shape).

Still to achieve this standard configuration (and referring to FIGS. 18A, 20A, 20C): away from the second frontward concavity 1909, at the rear of the mounting bracket 1610, the body is shaped to form an abutment 1616 that conforms with a portion of the surface of the blocking bar 1130. The abutment 1616 needs to grossly conform with a portion of the surface of the blocking bar 1130. It can be formed by having an upward rearward arm 1652 with a base 1652 protrude rearwardly in the rear of the body 1699 of the mounting bracket 1610. It can be the same arm 1654 within which the first rearward concavity 1904 is carved (i.e., the peripheric rear portion of the body). A spur 1688 may further define a concavity comprising the abutment 1616.

To ensure that the coupler 1120 is snuggly or firmly held by the mounting bracket 1610 in both configurations, the centroid of the body 1699 forming the mounting bracket 1610 should be found approximately between the second frontward concavity 1909 and the abutment 1616 (which are opposed to each other with respect to said centroid), and approximately between the first rearward concavity 1904 and the abutment 1678 (which are also opposed to each other with respect to said centroid). The reference number 1699 of the body is approximately located at a centroid in FIG. 19B.

The first rearward concavity 1904 and the first frontward concavity 1908 are paired together (first or more forward pair) to receive the two different hinge shafts (1124*b* and 1124*a*, respectively) simultaneously in the reverse configuration. The second rearward concavity 1905 and the second frontward concavity 1909 are paired together (second or more rearward pair) to receive the two different hinge shafts (1124*a* and 1124*b*, respectively) simultaneously in the standard configuration.

Accordingly, the first rearward concavity 1904 and the second frontward concavity 1909 should have the same radius of curvature as they receive the same hinge shaft 1124*b* alternately, and the second rearward concavity 1905 and the first frontward concavity 1908 should have the same radius of curvature as they receive the same hinge shaft 1124*a* alternately. Both pairs of concavities and hinge shafts are likely to have the same radius of curvature, although they may differ since each concavity receives only a single one of the hinge shafts 1124*a*, 1124*b*. According to an embodiment, the first and the second rearward concavities 1904, 1905 (or first set of adjacent concavities 1614) have the same radius of curvature but the geometrical center of said curvature is offset such that both arcs of circle are distinct; the spacing between them is small than the diameter corresponding to said arc-of-circle or radius of curvature, such that the first and the second rearward concavities 1904, 1905 touch themselves and are joined at this point by a rear apex 1921, as shown in FIG. 19B. Similarly, the first and the second frontward concavities 1908, 1909 (or second set of adjacent concavities 1618) touch themselves and are joined at this point by a front apex 1922.

Upwardly, between the sets of adjacent concavities (1614, 1618), there are found opposed inclined edges 1662, 1664, shown in FIGS. 19A-19B, which are inclined downwardly away from a center having a central apex 1660.

According to an embodiment, the body comprises a notch 1686 that conforms to a corresponding notch in the bucket 10 to be assembled with the mounting bracket 1610.

Figure 16A:
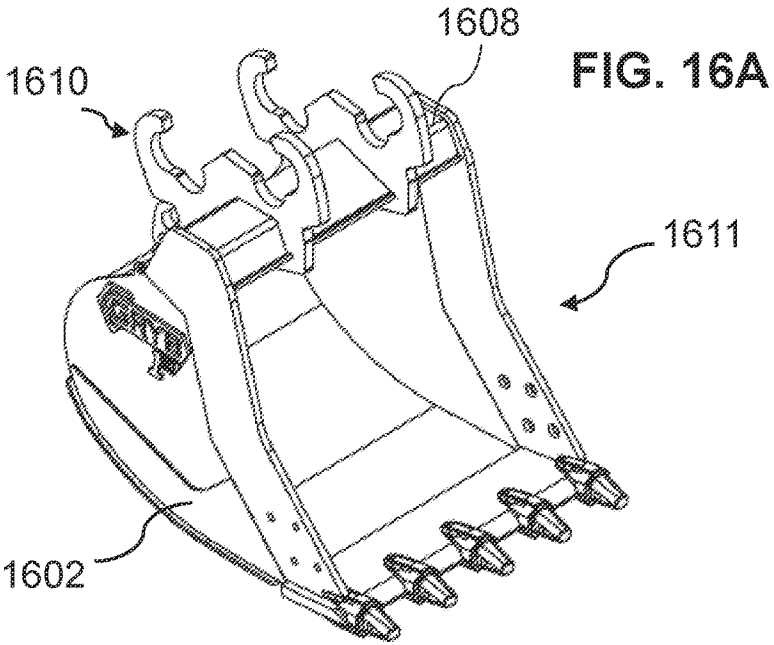
FIGS. 16A-16D are a perspective view, a top view, a front view and a side view, respectively, illustrating an excavator bucket including a mounting bracket, according to a fifth embodiment.
Figure 16B:
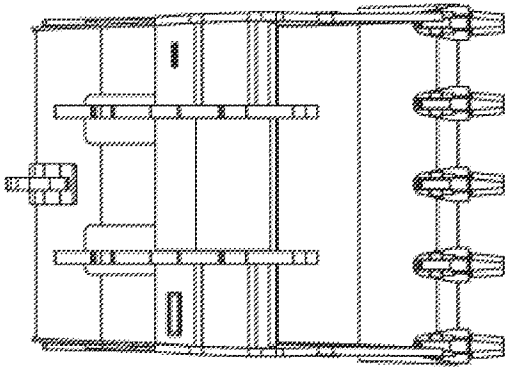
Figure 16C:
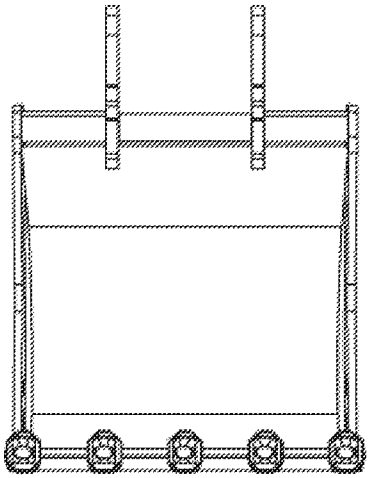
Figure 16D:
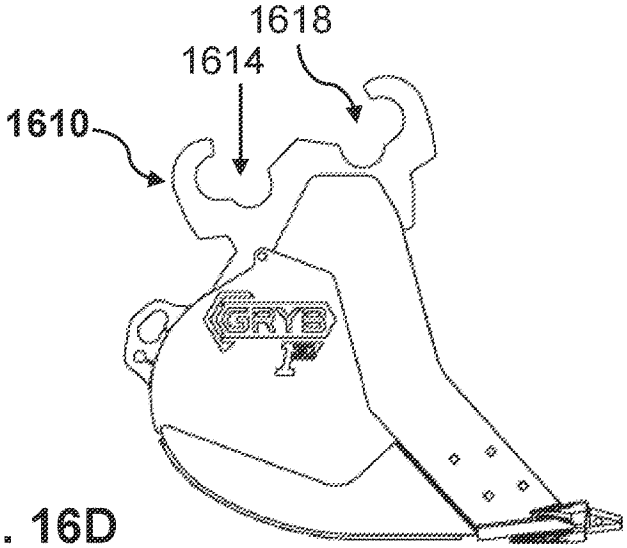
Figure 17A:
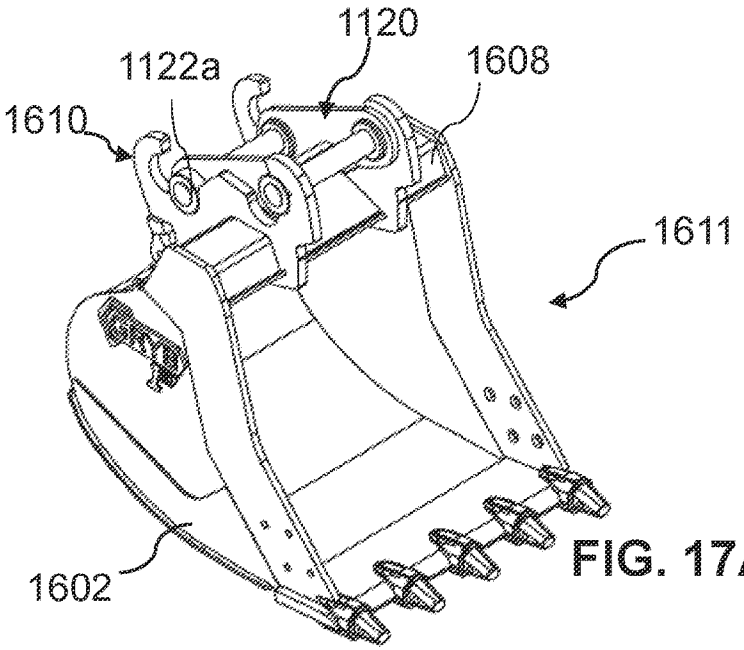
FIGS. 17A-17D are a perspective view, a top view, a front view and a side view, respectively, illustrating an excavator bucket including a mounting bracket cooperatively mounted on the coupler of the articulated arm, in the standard orientation, according to a fifth embodiment.
Figure 17C:
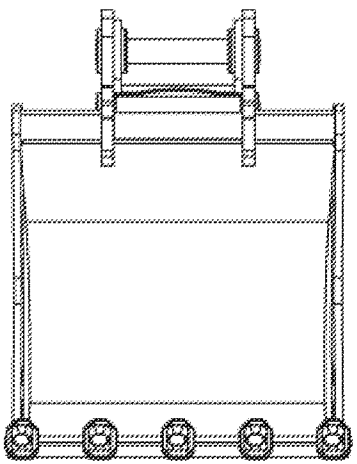
Figure 17B:
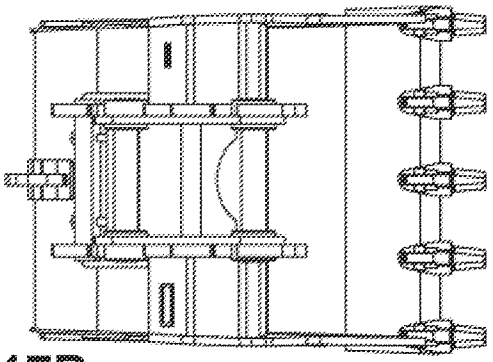
Figure 17D:
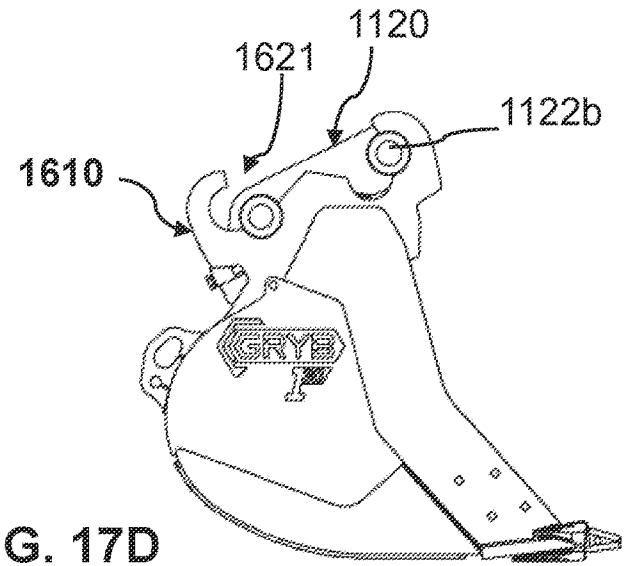
Figure 18A:
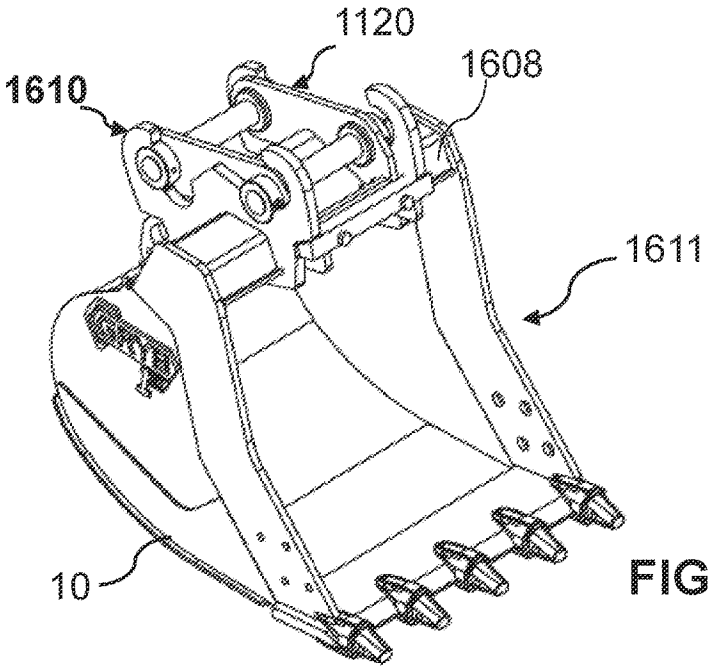
FIGS. 18A-18D are a perspective view, a top view, a front view and a side view, respectively, illustrating an excavator bucket including a mounting bracket cooperatively mounted on the coupler of the articulated arm, in the reverse orientation, according to a fifth embodiment.
Figure 18C:
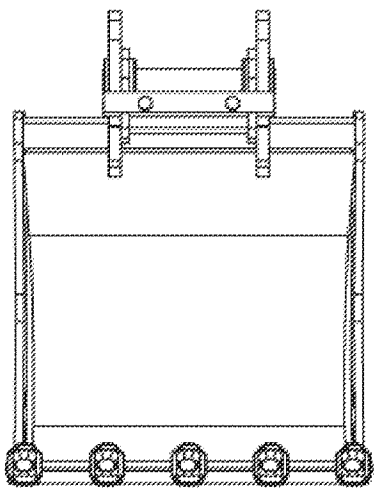
Figure 18B:
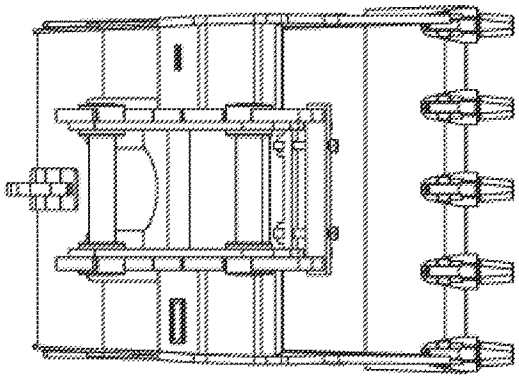
Figure 18D:
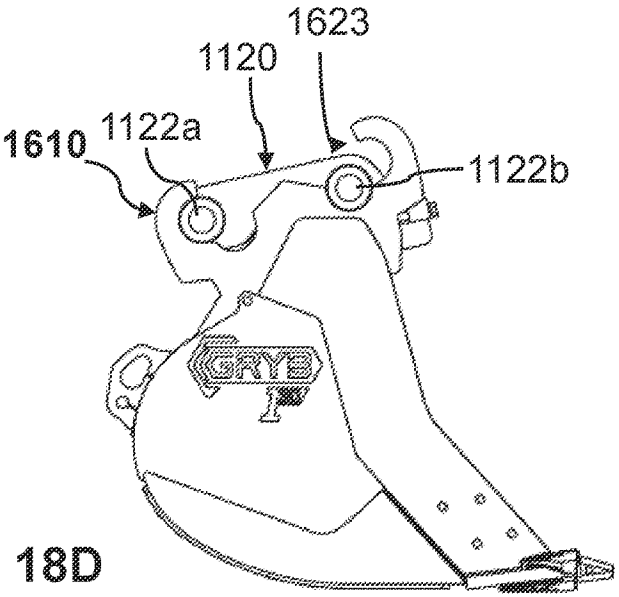

According to an embodiment, the body also comprises a notch 1680 formed by a rearwardly protruding arm 1676 that conforms to an edge 1608 of the bucket 10 to be assembled with the mounting bracket 1610, as shown in FIG. 16A, 17A or 18A.

This shape of the body 1699 of the mounting bracket 1610 combined to the coupler 1120 therefore makes the mounting bracket 1610 adapted for reversible mounting orientation, in addition to the standard mounting orientation achieved in the prior art. Unlike the prior art bracket 100', for which only one standard orientation was possible with respect to the coupler 20 on the articulated arm, the mounting bracket 1610 allows two different and opposite orientations. If a different orientation is required for scraping with the bucket or for a specific application using the bucket, the mounting bracket 1610 can provide the required adaptability.

The embodiment of the mounting bracket 1610 is advantageous in that whether in standard or in reverse configuration, there are three points of contact which ensure that the mounting bracket 1610 and the coupler 1120 can lock together when configured so. The mounting bracket 1610 and the coupler 1120 are therefore held in place particularly firmly, which is more secure overall.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A bracket for reversibly mounting an excavation bucket on a coupler of an articulated arm, the bracket comprising:

a body extending in a plane and having a centroid;

a first rear concavity and a second rear concavity which are adjacent on the body by a rear portion thereof, the first rear concavity more rearwardly located and oriented frontwardly and the second rear concavity closer to the centroid of the body and oriented upwardly;

a first front concavity and a second front concavity which are adjacent on the body by a front portion thereof, the first front concavity closer to the centroid of the body and oriented upwardly and the second front concavity more frontwardly located and oriented rearwardly;

wherein the first rear concavity and the second front concavity are for alternately receiving one of the hinge shaft or stopper thereof of the coupler;

wherein the first rear concavity and the second rear concavity respectively form an arc-of-circle, both being in contact and joined at a rear apex, wherein the second rear concavity and the first front concavity are for alternately receiving another one of the hinge shaft or stopper thereof of the coupler, thus allowing reversible mounting on the coupler.

2. The bracket of claim 1, further comprising:

a first abutment formed at the rear portion of the body for receiving a blocking bar of the coupler in the first one of two reversible configurations; and a second abutment formed at the front portion of the body for receiving a blocking bar of the coupler in the second one of two reversible configurations.

3. The bracket of claim 2, further comprising a notch at a bottom of the bracket for conforming to a corresponding portion of a bucket assembled with the coupler.

4. The bracket of claim 3, wherein the notch is formed at a bottom of a downward arm, a base thereof located by the second abutment formed at the front portion of the body.

5. The bracket of claim 4, wherein the second front concavity is formed by a front arm extending upwardly at the front portion of the body, a base of said front arm comprising the second abutment.

6. The bracket of claim 5, wherein the first abutment formed at the rear portion of the body is formed at an upper edge of a rear concavity, a bottom thereof forming a spur which is for conforming to a corresponding portion of a bucket assembled with the coupler.

7. The bracket of claim 6, wherein the first rear concavity is formed by a rear arm extending upwardly at the rear portion of the body, a base of said rear arm comprising the first abutment.

8. The bracket of claim 1, wherein the first rear concavity and the second rear concavity have a same radius of curvature.

9. The bracket of claim 1, wherein the first front concavity and the second front concavity have a same radius of curvature and respectively form an arc-of-circle, both being in contact and joined at a front apex.

10. A method for reversibly mounting an excavation bucket on a coupler of an articulated arm, the method comprising:

providing a bracket comprising:

a body extending in a plane and having a centroid;

a first rear concavity and a second rear concavity which are adjacent on the body by a rear portion thereof, the first rear concavity more rearwardly located and oriented frontwardly and the second rear concavity closer to the centroid of the body and oriented upwardly, wherein the first rear concavity and the second rear concavity respectively form an arc-of-circle, both being in contact and joined at a rear apex;

a first front concavity and a second front concavity which are adjacent on the body by a front portion thereof, the first front concavity closer to the centroid of the body and oriented upwardly and the second front concavity more frontwardly located and oriented reawardly;

in a first standard configuration of the coupler:

inserting a rear hinge shaft of the coupler or a side stopper thereof in the second rear concavity;

inserting a front hinge shaft of the coupler or a side stopper thereof in the second front concavity;

reversibly mounting the bracket and the coupler into a second reversed configuration by:

removing the bracket from the coupler inserting a rear hinge shaft of the coupler or a side stopper thereof in the first front concavity; and inserting a front hinge shaft of the coupler or a side stopper thereof in the first rear concavity.

11. The method of claim 10, further comprising:

in the first standard configuration of the coupler:

abutting a blocking bar of the coupler on a rear abutment at the rear portion of the bracket;

and in reversibly mounting the bracket and the coupler into the second reversed configuration:

abutting the blocking bar of the coupler on a front abutment at a front portion of the bracket.

* * * * *